US007891786B2

(12) United States Patent
Kaga

(10) Patent No.: US 7,891,786 B2
(45) **Date of Patent: *Feb. 22, 2011**

(54) INK-JET PRINTER AND METHOD OF CONTROLLING INK-JET PRINTER

(75) Inventor: Hikaru Kaga, Aisai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 924 days.

This patent is subject to a terminal disclaimer.

(21) Appl. No.: 11/383,940

(22) Filed: May 17, 2006

(65) Prior Publication Data

US 2006/0262172 A1 Nov. 23, 2006

(30) Foreign Application Priority Data

May 17, 2005 (JP) ..... 2005-144538

(51) Int. Cl.
*B41J 2/175* (2006.01)

(52) U.S. Cl. ..... 347/85; 347/84

(58) Field of Classification Search ..... 347/7, 347/84, 85; 141/2, 18
See application file for complete search history.

(56) References Cited

U.S. PATENT DOCUMENTS 5,485,187 A * 1/1996 Okamura et al. ..... 347/85
6,224,198 B1 * 5/2001 Cook et al. ..... 347/85
6,290,343 B1 * 9/2001 Lewis et al. ..... 347/85
6,318,850 B1 * 11/2001 Childers et al. ..... 347/85
6,513,902 B1 * 2/2003 Amano et al. ..... 347/23
6,840,604 B2 * 1/2005 Kimura et al. ..... 347/85
7,261,399 B2 * 8/2007 Miki ..... 347/85

* cited by examiner

*Primary Examiner*—Anh T. N. Vo
(74) *Attorney, Agent, or Firm*—Baker Botts L.L.P.

(57) ABSTRACT

An ink-jet printer, including an ink-jet recording head having an ink inlet into which an ink inflows; an ink tank which stores the ink and which has an ink outlet from which the ink outflows and additionally has an air inlet into which an air inflows; a first connector having an ink supply passage which communicates, at one end thereof, with the ink outlet of the ink tank and communicates, at an other end thereof, with the ink inlet of the ink-jet recording head; an air-pressure regulating device which has an air outlet from which the air outflows and additionally has a second connector having an air supply passage which communicates, at one end thereof, with the air outlet and communicates, at an other end thereof, with the air inlet of the ink tank; an amount obtaining portion which obtains at least one of (a) an amount of the ink present in the ink tank and (b) an amount of the air present in the ink tank; and an operation control portion which controls, based on the amount obtained by the amount obtaining portion an operation of the air-pressure regulating device to regulate a pressure of the air present in the ink tank, to a predetermined value.

25 Claims, 18 Drawing Sheets

INK-JET PRINTER AND METHOD OF CONTROLLING INK-JET PRINTER

The present application is based on Japanese Patent Application No. 2005-144538 filed on May 17, 2005, the contents of which are incorporated herein by reference.

BACKGROUND OF THE INVENTION

1. Field of the Invention

The present invention relates to an ink-jet printer that ejects droplets of ink onto a recording medium and a method of controlling an ink-jet printer.

2. Discussion of Related Art

An ink-jet recording head having a plurality of ink ejection nozzles and a plurality of pressure chambers communicating with the nozzles, respectively, may have a problem that air bubbles and deteriorated ink remain in the nozzles and/or the pressure chambers and accordingly an ink-ejection performance of the recording head lowers. To solve this problem, it is needed to carry out a purging operation to purge the recording head of the air bubbles and the deteriorated ink. For example, Japanese Patent Application Publication No. 2004-58348 or its corresponding U.S. Patent Application Publication No. 2004/0196326A1 discloses an ink-jet printer that includes an ink-jet recording head; an ink tank that stores ink to be supplied to the recording head; an air tank that stores air having a predetermined pressure; and an air pump that supplies the air to the air tank, and that carries out a purging operation. When the ink-jet printer carries out the purging operation, first, in a state in which an air valve that is provided between the air tank and the ink tank is closed, the air is supplied from the air pump to the air tank, so that the air pressure in the air tank is increased up to the predetermined value. Then, when the air valve is opened, the air in the air tank (i.e., the pressurized air) instantaneously is supplied to the ink tank. Consequently the air pressure in the ink tank is increased up and the ink is quickly supplied to the recording head. Since the ink is quickly supplied to the recording head, the air bubbles and the deteriorated ink remaining in the recording head are forcedly discharged from the nozzles thereof

SUMMARY OF THE INVENTION

However, in the above-indicated ink-jet printer, the air pump is operated to increase the air pressure in the air tank, up to the predetermined value, irrespective of what amount of the ink may be present in the ink tank. Therefore, in the case where the amount of the ink present in the ink tank is greater than a reference ink amount assuring that the air pressure in the ink tank becomes equal to a desired pressure immediately after the air valve is opened, the air pressure in the ink tank immediately after the air valve is opened becomes higher than the desired pressure and accordingly an excessive amount of the ink is discharged from the recording head; and in the case where the amount of the ink present in the ink tank is smaller than the reference ink amount, the air pressure in the ink tank immediately after the air valve is opened becomes lower than the desired pressure and accordingly an insufficient amount of the ink is supplied to the recording head and the air bubbles and the deteriorated ink may not be efficiently discharged from the recording head.

It is therefore an object of the present invention to solve at least one of the above-indicated problems. It is another object of the present invention to provide an ink-jet printer and an ink-jet-printer controlling method each of which assures that air bubbles and/or ink whose properties have changed (e.g., its viscosity has increased) are discharged in a purging operation while useless consumption of the ink is prevented.

The above objects may be achieved according to the present invention. According to a first aspect of the present invention, there is provided an ink-jet printer, including an ink-jet recording head having an ink inlet into which an ink inflows; an ink tank which stores the ink and which has an ink outlet from which the ink outflows and additionally has an air inlet into which an air inflows; a first connector having an ink supply passage which communicates, at one end thereof, with the ink outlet of the ink tank and communicates, at an other end thereof, with the ink inlet of the ink-jet recording head; an air-pressure regulating device which has an air outlet from which the air outflows and additionally has a second connector having an air supply passage which communicates, at one end thereof, with the air outlet and communicates, at an other end thereof, with the air inlet of the ink tank; an amount obtaining portion which obtains at least one of (a) an amount of the ink present in the ink tank and (b) an amount of the air present in the ink tank; and an operation control portion which controls, based on the amount obtained by the amount obtaining portion, an operation of the air-pressure regulating device to regulate a pressure of the air present in the ink tank, to a predetermined value.

According to a second aspect of the present invention, there is provided a method of controlling an ink-jet printer having an ink inlet into which an ink inflows; an ink tank which stores the ink and which has an ink outlet from which the ink outflows and an air inlet into which an air inflows; a first connector having an ink supply passage which communicates, at one end thereof, with the ink outlet of the ink tank and communicates, at an other end thereof, with the ink inlet of the ink-jet recording head; and an air-pressure regulating device including an air outlet from which the air outflows, and a second connector having an air supply passage which communicates, at one end thereof, with the air outlet and communicates, at an other end thereof, with the air inlet of the ink tank. The method comprises obtaining at least one of (a) an amount of the ink present in the ink tank and (b) an amount of the air present in the ink tank, and controlling, based on the obtained amount, an operation of the air-pressure regulating device to regulate a pressure of the air present in the ink tank, to a predetermined value.

In the above-indicated ink-jet printer or the above-indicated ink-jet-printer controlling method, the operating condition of the air-pressure regulating device is determined based on at least one of the amount of the ink present in the ink tank and the amount of the air present in the ink tank. Therefore, irrespective of whether the amount of the ink present in the ink tank is great or small, air bubbles and/or deteriorated ink can be reliably discharged from the ink-jet recording head, while useless consumption of the ink is prevented.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Hereinafter, there will be described preferred embodiments of the present invention by reference to the drawings.

First Embodiment

Figure 1:
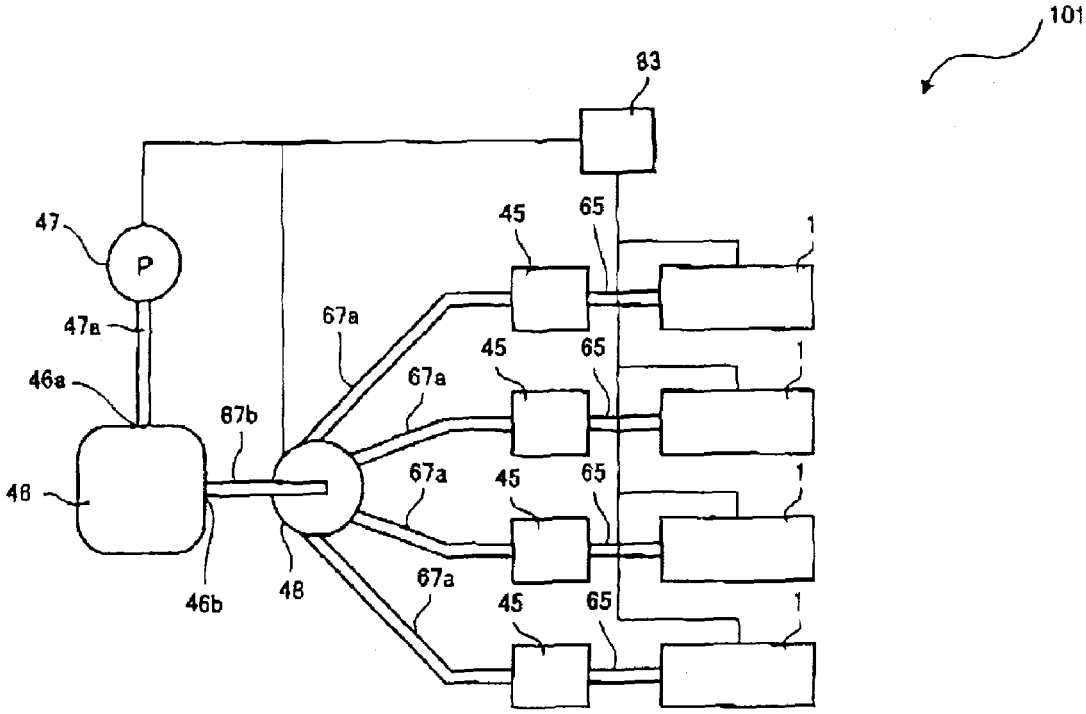
FIG. 1 is a schematic view of an ink-jet printer to which the present invention is applied.

FIG. 1 schematically shows a construction of an ink-jet printer 101 as a first embodiment of the present invention. The ink-jet printer 101 is for recording a desired image on a recording medium such as a recording sheet, by ejecting droplets of inks onto the sheet. As shown in FIG. 1, the ink-jet printer 101 includes four ink-jet recording heads 1; four ink tanks 45 corresponding to the four ink-jet heads 1, respectively; an air tank 46; an air pump 47; a switching unit (i.e., an air valve) 48; and a control device 83.

Each ink-jet head 1 is a serial-type head that ejects droplets of an ink onto the recording sheet while being moved in a main scan direction perpendicular to a sub-scan direction in which the recording sheet is fed by a feeding device, not shown. The four ink-jet heads 1 are configured such that the four heads 1 eject droplets of four different inks, respectively. The four different inks are a cyan ink, a yellow ink, a magenta ink, and a black ink. Thus, the ink-jet printer 101 prints or records a full-color image on the recording sheet.

Figure 2:
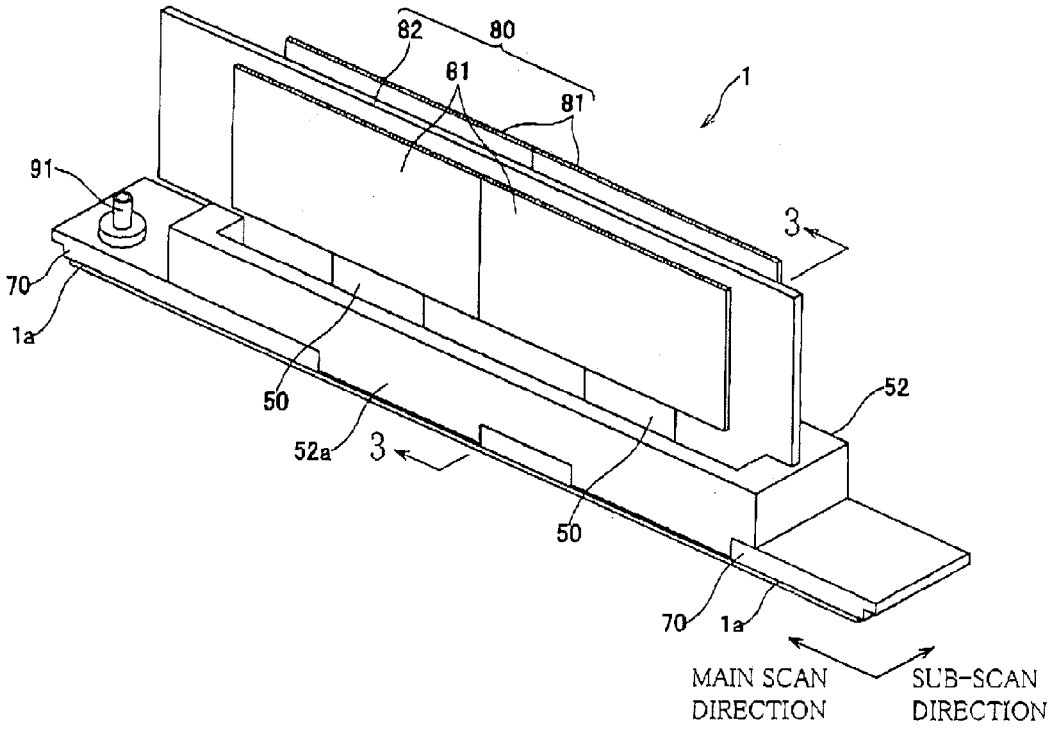
FIG. 2 is a perspective view of an ink-jet recording head of the printer of FIG. 1.
Figure 3:
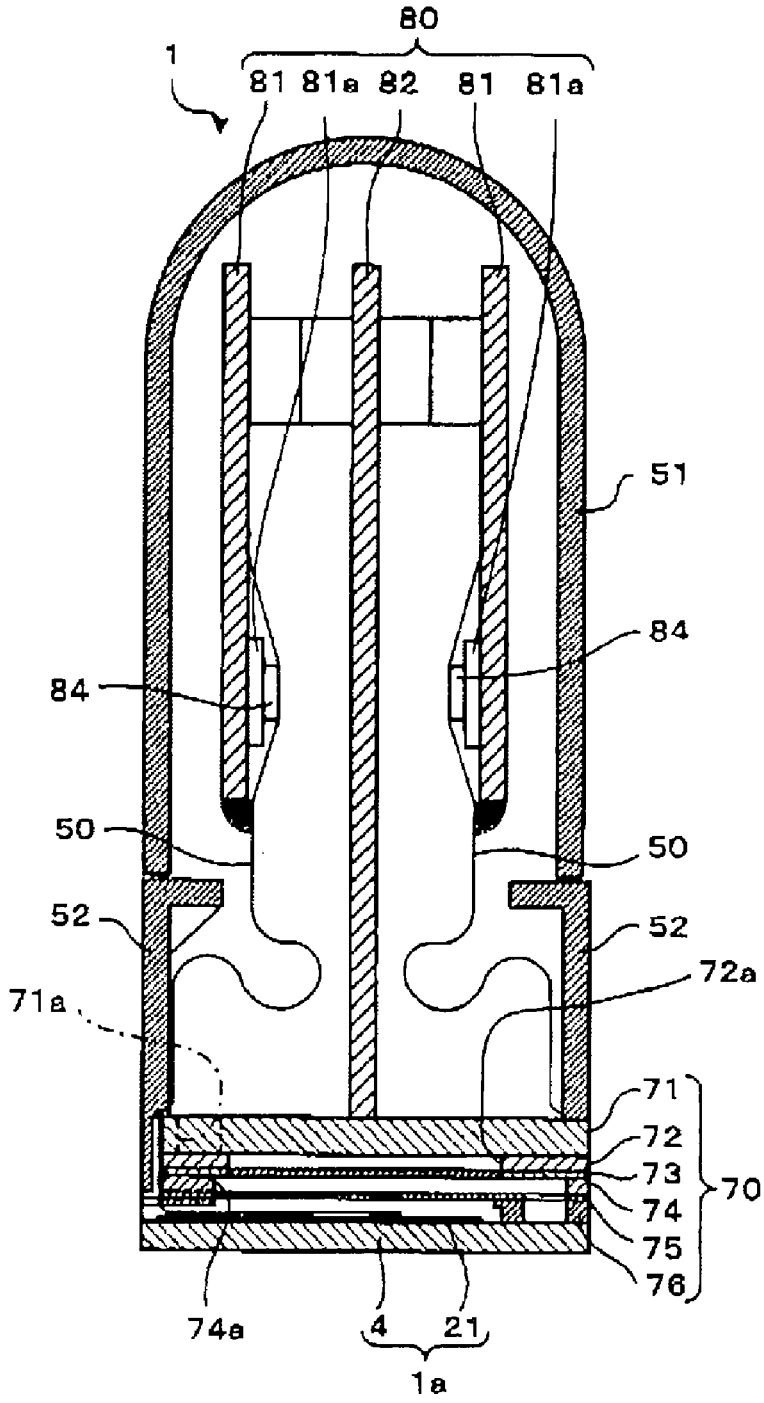
FIG. 3 is a cross-sectional view of the ink-jet recording head, taken along 3-3 in FIG. 2.

Hereinafter, one of the ink-jet heads 1 each having an identical construction will be described in detail by reference to FIGS. 2 and 3. As shown in those figures, the ink-jet head 1 has a shape elongate in the main scan direction, and includes a main portion 1*a*, a reservoir unit 70, and a control portion 80 that controls an operation of the main portion 1*a*.

The control portion 80 controls the ink-jet head 1 based on commands supplied thereto from the control device 83. The control portion 80 includes a main substrate 82; four auxiliary substrates 81 two of which are provided on one side of the main substrate 82 and the other two of which are provided on the other side of the same 82; and four driver ICs (integrated circuits) 81*a* that are fixed to respective inner surfaces of the four auxiliary substrates 81 that are opposed to the main substrate 82. The main portion 1*a* of the ink-jet head 1 includes four actuator units 21. The four driver ICs 81*a* produce respective drive signals to drive the four actuator units 21. Four heat sinks 84 are fixed to respective surfaces of the four driver ICs 81*a* that are opposed to the main substrate 82.

Four FPCs (flexible printed circuits) 50 each as a power-supply member are connected, at respective one ends thereof, to the four actuator units 21, and are connected, at the respective other ends thereof, to the four auxiliary substrates 81, respectively. In addition, the four FPCs 50 are connected, midway between the four actuator units 21 and the four auxiliary substrates 81, to the four driver ICs 81*a*, respectively. That is, the four FPCs 50 are electrically connected to the four auxiliary substrates 81 and the four driver ICs 81*a*, and transmit respective signals outputted from the four auxiliary substrates 81, to the four driver ICs 81*a*, and supplies the respective drive signals outputted from the four driver ICs 81*a*, to the four actuator units 21.

The ink-jet head 1 further includes an upper cover 51 that covers the control portion 80; and a lower cover 52 that covers a lower portion of the head 1. The upper cover 51 has an arched ceiling covering the control portion 80. The lower cover 52 has a generally rectangular tubular shape with upper and lower open ends, and covers the lower portion of the main substrate 82. The upper and lower covers 51, 52 cooperate with each other to prevent ink scattered in a printing operation, from adhering to, e.g., the control portion 80. In FIG. 2, the upper cover 51 is removed from the ink-jet head 1, just for allowing the control portion 80 to be seen.

Figure 4:
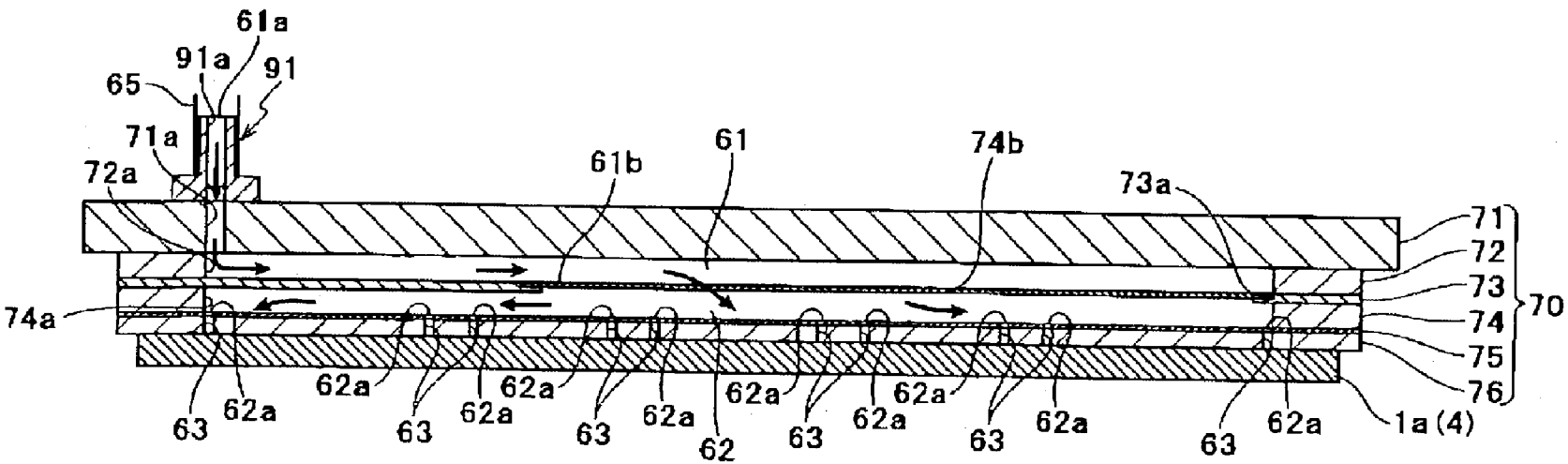
FIG. 4 is a cross-sectional view of a reservoir unit and a main portion of the ink-jet recording head, taken in a main scanning direction.

Next, the reservoir unit 70 will be described by reference to FIG. 4, i.e., a cross-sectional view taken along a plane parallel to the main scan direction. However, it is noted that in FIG. 4, a degree of contraction of a scale in a vertical direction is smaller than that in a horizontal direction, for easier understanding purposes only. In addition, FIG. 4 shows, for the same reason, different ink flow passages that cannot be seen in a cross-sectional view taken along a single plane.

The reservoir unit 70 is for temporarily storing the ink, and supplies it to the main portion 1*a*. As shown in FIG. 4, the reservoir unit 70 has a stacked structure in which six plate members 71, 72, 73, 74, 75, 76 each of which has a rectangular flat shape elongate in the main scan direction (FIG. 2) are stacked on each other. The reservoir unit 70 has an ink inflow passage 61, an ink reservoir 62, and a plurality of ink introduction passages 63. A joint member 91 is fixed to one of lengthwise opposite end portions of an upper surface of the reservoir unit 70, and a cylindrical space 91*a* is formed in the joint member 91. An ink supply tube 65 as a first connector having an ink supply passage is connected to the joint member 91.

The ink supplied from the ink tank 45 flows into the ink inflow passage 61 via the ink supply tube 65. The ink inflow passage 61 includes the cylindrical space 91*a*; a through hole

71*a* that is formed through the thickness of the plate member 71 such that the through hole 71 is aligned with the cylindrical space 91*a*; and an opening 72*a* that is formed through the thickness of the plate member 72 such that the opening 72*a* extends from one end portion of the plate member 72 that is opposed to the cylindrical space 91*a*, to the other end portion of the same 72. In addition, an upper open end of the cylindrical space 91*a* constitutes an ink inlet 61*a*. An opening 73*a* is formed, through the thickness of the plate member 73, and constitutes a reservoir communication opening 61*b* of the ink inflow passage 61.

The reservoir 62 is for temporarily storing the ink flowing from the ink inflow passage 61 through the reservoir communication opening 61*b* thereof, and includes an opening 74*a* that is formed through the thickness of the plate member 74 such that the opening 74*a* extends from one end portion of the plate member 74 that is opposed to the cylindrical space 91*a*, to the other end portion of the same 74. A plurality of holes are formed through the thickness of the plate member 75, and constitute a plurality of introduction-passage communication holes 62*a* through which the reservoir 62 communicates with the plurality of ink introduction passages 63, respectively. The opening 73*a* has, along a periphery thereof, a stepped portion or surface that supports a filter member 74*b* that removes dust from the ink.

The ink introduction passages 63 are for introducing the ink stored in the reservoir 62, into the main portion 1*a*, and are formed in the plate member 76 such that the ink introduction passages 63 are aligned with the introduction-passage communication holes 62*a* of the plate member 75. The ink introduction passages 63 communicate, at respective one ends thereof, with the introduction-passage communication holes 62*a*, and communicate, at the respective other ends thereof, with a plurality of ink supply ports 5*b* (FIG. 5) opening in an upper surface of a flow-channel unit 4 (described later) of the main portion 1*a*.

Next, how the ink flows into the reservoir unit 70 will be described. As indicated by arrows in FIG. 4, first, the ink flows, through the ink inlet 61*a*, into the ink inflow passage 61, and then flows, through the reservoir communication opening 61*b*, into the reservoir 62. Subsequently, the ink flows, through the introduction-passage communication holes 62*a*, into the ink introduction passages 63. Then, the ink flows from the ink introduction passages 63 to the flow-channel unit 4 of the main portion 1*a* via the ink supply ports 5*b*.

Next, the main portion 1*a* of the ink-jet head 1 will be described by reference to FIGS. 5 through 8. FIG. 6 is an enlarged view of an area, A, indicated by one-dot chain line in FIG. 5. In FIG. 6, since nozzles 8, pressure chambers 10, and apertures 12 are located under the actuator units 21, those elements 8, 10, 12 should be drawn with broken lines. In the figure, however, those elements 8, 10, 12 are drawn with solid lines, for easier understanding purposes only.

Figure 5:
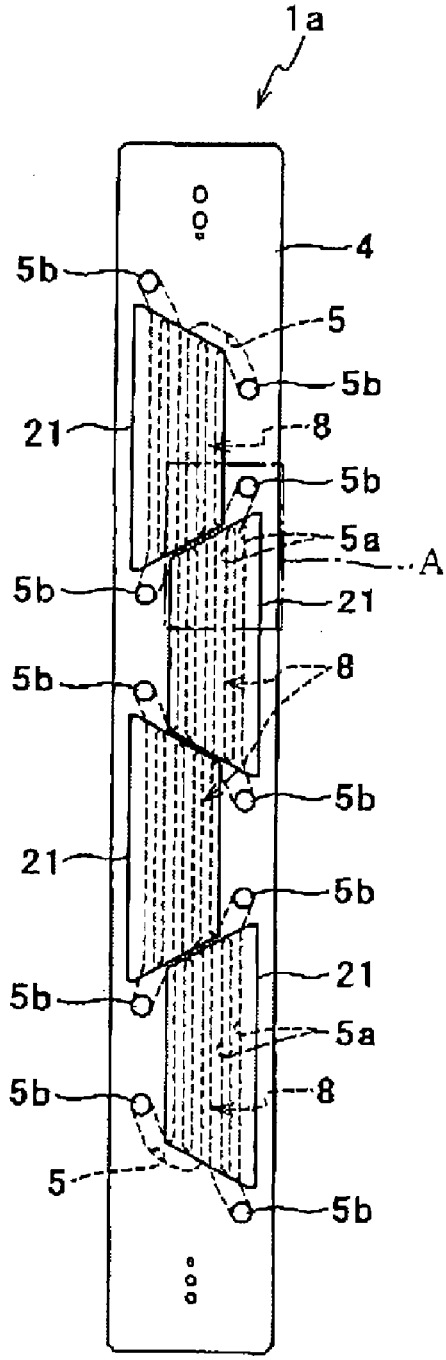
FIG. 5 is a plan view of the main portion of the ink-jet recording head.
Figure 6:
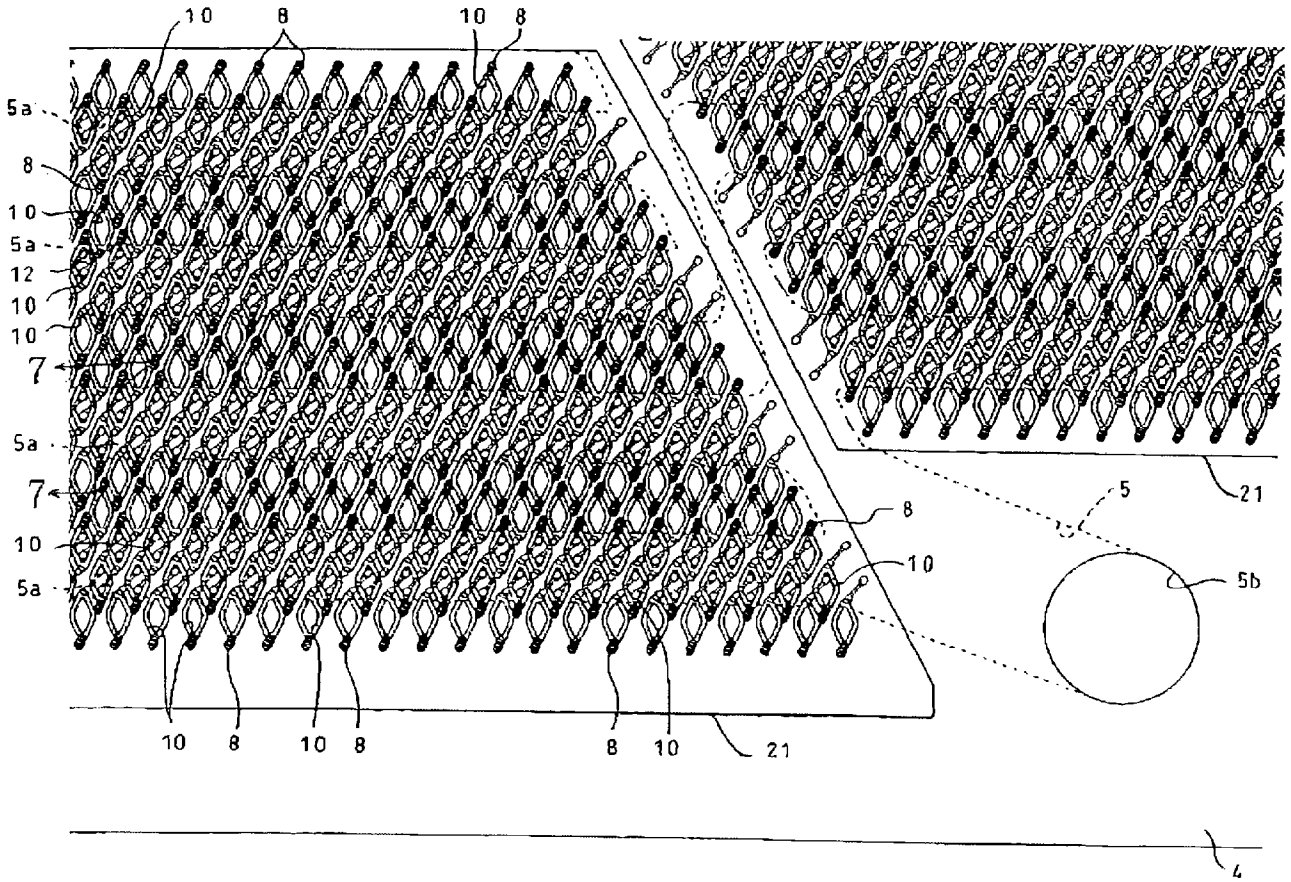
FIG. 6 is an enlarged view of a portion, A, of the main portion, indicated by one-dot chain line in FIG. 5.

As shown in FIG. 5, the main portion 1*a* includes the flow-channel unit 4, and the four actuator units 21 fixed to the upper surface of the flow channel unit 4. Each of the actuator units 21 is for applying an ejection energy to an arbitrary one of a corresponding one of four groups of pressure chambers 10 that are formed in the flow channel unit 4.

The flow channel unit 4 has a substantially rectangular-parallelepiped shape extending in the main scan direction. As shown in FIG. 6, the main portion 1*a* has, as a lower surface thereof, an ink ejection surface having a plurality of nozzles 8 arranged like a matrix. In addition, the flow-channel unit 4 has, in the upper surface thereof to which the actuator units 21 are fixed, a plurality of pressure chambers 10 that are arranged like a matrix such that the pressure chambers 10 correspond to the nozzles 8, respectively.

Figure 7:
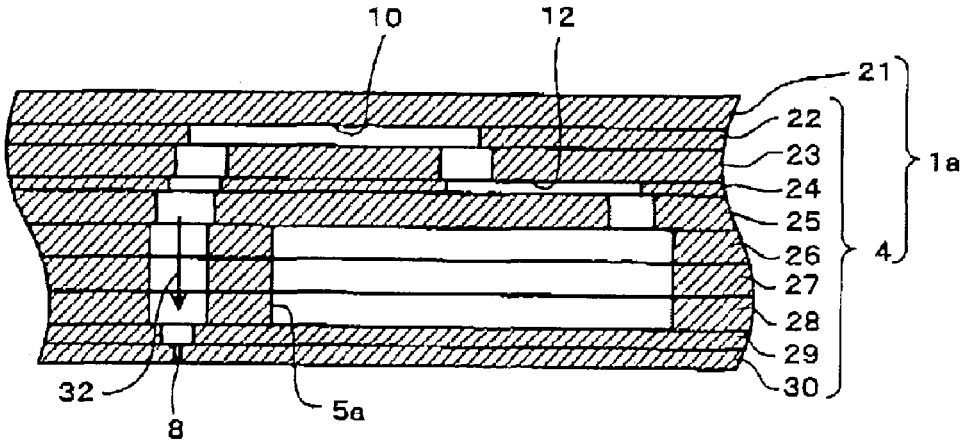
FIG. 7 is a cross-sectional view taken along 7-7 in FIG. 6.

As shown in FIG. 7, the flow-channel unit 4 has a stacked structure in which nine metallic plates are stacked on each other. Those nine plates include a cavity plate 22, a base plate 23, an aperture plate 24, a supply plate 25, three manifold plates 26, 27, 28, a cover plate 29, and a nozzle plate 30.

As shown in FIG. 5, the flow-channel unit 4 has the plurality of ink supply ports 5*b* that open in the upper surface thereof such that the ink supply ports 5*b* correspond to the introduction-passage communication holes 62*a* or the ink introduction passages 63 (FIG. 4) of the reservoir unit 70, respectively. The flow-channel unit 4 has a plurality of manifold flow channels 5 that communicate with the ink supply ports 5*b*; and a plurality of sub-manifold flow channels 5*a* that are branched from the manifold flow channels 5. As shown in FIG. 7, each of the nozzles 8 communicates with a corresponding one of a plurality of individual ink flow channels 32 including the manifold flow channels 5, the sub-manifold flow channels 5*a*, and the pressure chambers 10. More specifically described, the ink is supplied from the reservoir unit 70 to the flow channel unit 4 via the ink supply ports 5*b*, then flows from the manifold flow channels 5 to the sub-manifold flow channels 5*a*, and reaches the nozzles 8 via the apertures 12 each functioning as a restrictor, and the pressure chambers 10.

Figure 8:
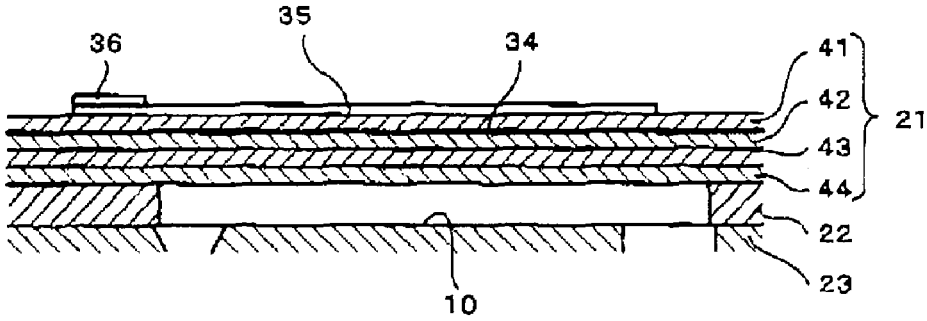
FIG. 8 is an enlarged cross-sectional view of an actuator unit of the main portion.

As shown in FIG. 5, each of the four actuator units 21 has a generally trapezoidal shape in its plan view. The four actuator units 21 are fixed to the upper surface of the flow-channel unit 4, such that the actuator units 21 are arranged in two arrays in a zigzag or staggered fashion, and such that each of the actuator units 21 does not overlap any of the ink supply ports 5*b* of the flow-channel unit 4. In addition, as shown in FIG. 8, each of the four actuator units 21 has a stacked structure in which four piezoelectric sheets 41, 42, 43, 44 are stacked on each other, and is fixed to the flow channel unit 4 such that the four piezoelectric sheets 41, 42, 43, 44 of the each actuator unit 21 are commonly opposed to the plurality of pressure chambers 10 of a corresponding one of the four groups of pressure chambers 10.

A plurality of individual electrodes 35 are provided on the uppermost piezoelectric sheet 41 of each actuator unit 21, such that the individual electrodes 35 correspond to the pressure chambers 10 of the corresponding pressure-chamber group, respectively. A sheet-like common electrode 34 is interposed between the uppermost piezoelectric sheet 41 and the underlying piezoelectric sheet 42, such that the common electrode 34 corresponds to the entirety of the two sheets 41, 42. No electrodes are provided between the two piezoelectric sheets 42, 43 or between the two piezoelectric sheets 43, 44.

Each of the individual electrodes 35 has, in its plan view, a substantially rhomboidal shape similar to that of each pressure chamber 10. More specifically described, one of two acute-angle corners of the each rhomboidal individual electrode 35 is extended and is electrically connected to a land 36. The lands 36, connected to the individual electrodes 35, are electrically connected to a plurality of terminals of a corresponding one of the four FPCs 50 (FIG. 3).

The common electrode 34 is grounded at a portion thereof, not shown, and is kept at a ground potential. On the other hand, respective electric potentials of the individual electrodes 35 of each actuator unit 21 can be controlled or changed, independent of each other, by a corresponding one of the four driver ICs 81*a* through respective independent leads of a corresponding one of the four FPCs 50 and the respective lands 36.

Next, a manner in which each actuator unit 21 is driven or operated will be described. Only the uppermost piezoelectric sheet 41 of each actuator unit 21 is polarized, in advance, in a direction of thickness thereof. Therefore, when a certain positive or negative electric voltage is applied to an arbitrary one of the individual electrodes 35, such that an electric field is produced in the same direction as the direction of polarization of a corresponding portion of the uppermost piezoelectric sheet 41 that is sandwiched by the arbitrary individual electrode 35 and the common electrode 34, the corresponding portion deforms owing to piezoelectric effect and thereby functions as an active portion. More specifically described, each of respective portions of the uppermost piezoelectric sheet 41 that are sandwiched by the individual electrodes 35 and the common electrode 34 expands or contracts in the direction of thickness thereof, and contracts or expands, owing to transverse piezoelectric effect, in the direction perpendicular to the direction of thickness thereof. On the other hand, none of the other piezoelectric sheets 42, 43, 44 deforms or displaces because those sheets 42 through 44 include no portions sandwiched by the individual electrodes 35 and the common electrode 34 and accordingly they are inactive sheets that cannot be influenced by the electric field.

Thus, each actuator unit 21 has a so-called uni-morph structure in which the uppermost piezoelectric sheet 41 distant from the pressure chambers 10 has the active portions and the other three piezoelectric sheets 42, 43, 44 near to the pressure chambers 10 have no active portions. The lower surface of each actuator unit 21 including the four piezoelectric sheets 41 through 44 is fixed to respective upper surfaces of a plurality of partition walls of the cavity plate 22 that define the pressure chambers 10. Therefore, if a strain difference is produced, in the direction perpendicular to the direction of thickness of each actuator unit 21, between each of the active portions of the uppermost piezoelectric sheet 41 and the underlying piezoelectric sheets 42, 43, 44, then the four piezoelectric sheets 41 through 44 are so deformed as to swell into the corresponding pressure chamber 10 (this is a "uni-morph" deformation). Thus, a volume of the pressure chamber 10 is decreased and a pressure of the ink present in the pressure chamber 10 is increased, so that the ink is expelled from the pressure chamber 10 toward the corresponding nozzle 8 and a droplet of the ink is ejected from the nozzle 8. Subsequently, when the electric potential of the individual electrode 35 is returned to the same level as that of the common electrode 34, the four piezoelectric sheets 41 through 44 are returned to their original shapes, so that the volume of the pressure chamber 10 is returned to its original volume and a certain amount of the ink is sucked from the corresponding manifold flow channel 5 into the pressure chamber 10.

Figure 9:
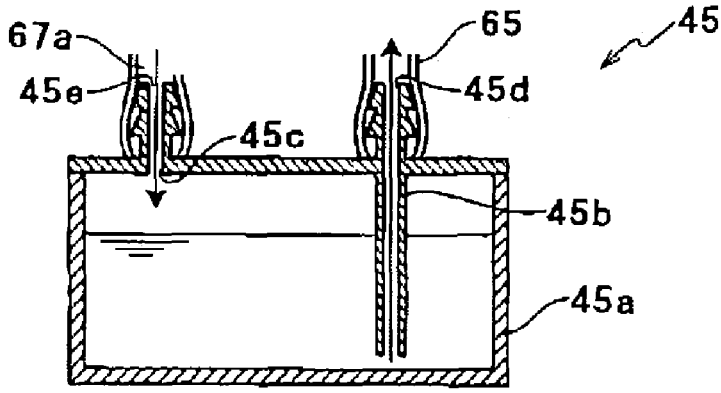
FIG. 9 is a cross-sectional view of an ink tank of the ink-jet printer.

Next, one of the four ink tanks 45 each having an identical construction will be described by reference to a cross-sectional view thereof shown in FIG. 9. The four ink tanks 45 are for storing respective different inks to be ejected by the four ink-jet recording heads 1. Those inks are a cyan ink, a yellow ink, a magenta ink, and a black ink. As shown in FIG. 9, each of the ink tanks 45 includes a main body 45*a*, an ink outflow tube 45*b*, and an air inflow tube 45*c*. The main body 45*a* is a box-like member that stores an ink, and has an inner air-tight space that is defined by closing, by supersonic welding, an upper opening of a lower box member with a lid member. Each of the ink outflow tube 45*b* and the air inflow tube 45*c* is inserted, through the lid member of the main body 45*a*, into the inner space thereof. The ink supply tube 65 is connected to a joint portion i.e., an upper end portion of the ink outflow tube 45*b*, and a lower end portion (i.e., a lower open end) of the same 45*b* is located at a height position near to a bottom wall of the main body 45*a*, i.e., a height position lower than a level of the ink present in the ink tank 45. An individual air supply tube 67*a* is connected to a joint portion, i.e., an upper end portion of the air inlet tube 45*c*, and a lower end portion (i.e., a lower open end) of the same 45*c* opens in a lower surface of the lid member of the main body 45*a*, i.e., a height position higher than the level of the ink present in the ink tank 45. An upper open end of the ink outflow tube 45*b* constitutes an ink outlet 45*d*; and an upper open end of the air outflow tube 45*c* constitutes an air inlet 45*e*. In a purging operation, described later, air flows into the air inlet 45*e*, so that a pressure of the air present in the main body 45*a* is increased and accordingly an appropriate amount of the ink is expelled from the ink outlet 45*d*.

Back to FIG. 1, the air tank 46 has an air outlet 46*b* and an air supply port 46*a*, and stores air supplied through the air supply port 46*a*. A common air supply tube 67*b* is connected to the air outlet 46*b*, and an air-pump communication tube 47*a* communicating with the air pump 47 is connected to the air supply port 46*a*. The air stored by the air tank 46 is supplied to each of the four ink tanks 45 via the respective individual air supply tubes 67*a*. The air pump 47 supplies, based on a command supplied from the control device 83, air to the air tank 46 via the air-pump communication tube 47*a*. Thus, the air tank 46, the air pump 47, and the air-pump communication tube 47*a* cooperate with each other to constitute an air supplying device. However, it can be said that only the air pump 47 constitutes an air supplying device. The individual air supply tubes 67*a* and the common air supply tube 67*b* cooperate with each other to constitute a second connector having an air supply passage.

Next, the switching unit 48 will be described by reference to FIGS. 10A, 10B, 10C, and 10D each of which shows a cross-sectional view of an upper portion of the unit 48, and FIGS. 10E, 10F, 10G, and 10H each of which shows a cross-sectional view of a lower portion of the unit 48. FIGS. 10A, 10B, 10C, and 10D show different operating states of the upper portion of the switching unit 48; and FIGS. 10E, 10F, 10G, and 10H show different operating states of the lower portion of the switching unit 48. The switching unit 48 is for selecting, based on a command supplied from the control device 83, one or more of the four ink tanks 45 to which air is to be supplied from the air tank 46, or selecting one or more of the four ink tanks 45 from which pressurized air is to be discharged into the atmosphere.

Figure 10A:
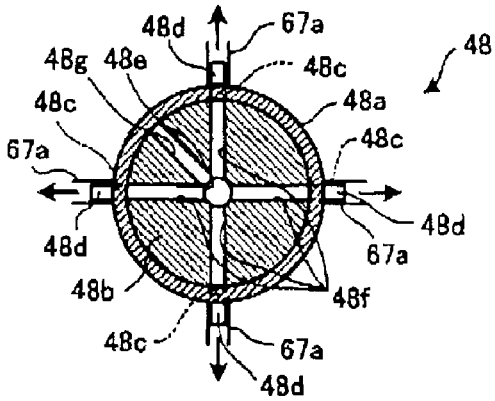
FIGS. 10A, 10B, 10C, and 10D are cross-sectional views showing different operating states of an upper portion of a switching unit of the ink-jet printer.

As shown in FIG. 10A, the switching unit 48 includes a cylindrical frame member 48*a* and a flow-passage member 48*b*. The cylindrical frame member 48*a* has an inner cylindrical space; eight through holes 48*c* that are formed through the thickness of the frame member 48*a* so as to connect between the inner cylindrical space thereof and an outer circumferential surface thereof, and eight joint portions 48*d* communicating with the eight through holes 48*c*, respectively. The eight through holes 48*c* open in the outer circumferential surface of the frame member 48*a*, such that the upper four through holes 48*c* are equiangularly distant from each other by 90 degrees and the lower four through holes 48*c* are equiangularly distant from each other by 90 degrees and are aligned with the upper four through holes 48*c*, respectively, in the vertical direction. The eight joint portions 48*d* communicate with the respective openings of the eight through holes 48*c*. Each of the four air supply tubes 67*a* are bifurcated into two tubular portions that are connected to a corresponding one of the four upper joint portions 48*d* and a corresponding one of the four lower four joint portions 48*d*, respectively. Thus, each of the four ink tanks 45 communicates with the corresponding two through holes 48*c* via the corresponding air supply tube 67*a*, respectively.

The flow-passage member 48*b* has a cylindrical shape, and fits in the inner cylindrical space of the frame member 48*a* such that the flow-passage member 48*b* is freely rotatable. The flow-passage member 48*b* has, in the upper portion thereof shown in FIGS. 10A through 10D, a first main flow passage 48*e* extending along an axis line of rotation of the member 48*b*; and four first auxiliary flow passages 48*f* and one second auxiliary flow passage 48*g* each of which communicates with the first main flow passage 48*e*, extends in a radial direction of the member 48*b*, and opens in an outer circumferential surface of the member 48*b*. The four first auxiliary flow passages 48*f* are equiangularly distant from each other by 90 degrees; and the second auxiliary flow passage 48*g* opens, in the outer circumferential surface of the flow-passage member 48*b*, at a position distant from 45 degrees from each of the respective openings of two first auxiliary flow passages 48*f* out of the four passages 48*f*. The first main flow passage 48*e* communicates, at one of opposite ends thereof, with the four first auxiliary flow passages 48*f* and the second auxiliary flow passage 48*g*, and communicates, at the other end thereof, with the common air supply tube 67*b* (FIG. 1). Thus, the air tank 46 communicates with the first main flow passage 48*e* via the common air supply tube 67*b*.

In addition the flow-passage member 48*b* has, in the lower portion thereof shown in FIGS. 10E through 10H, a second main flow passage 48*j* that extends along the axis line of rotation of the member 48*b*, is aligned with the first main flow passage 48*e* in the vertical direction, and is separated from the same 48*e* by an air-tight partition wall, not shown; and four third auxiliary flow passages 48*h* and one fourth auxiliary flow passage 48*i* each of which communicates with the third main flow passage 48*e*, extends in a radial direction of the member 48*b*, and opens in the outer circumferential surface of the member 48*b*. The four third auxiliary flow passages 48*h* are equiangularly distant from each other by 90 degrees; the fourth auxiliary flow passage 48*i* opens, in the outer circumferential surface of the flow-passage member 48*b*, at a position distant from 45 degrees from each of the respective openings of two third auxiliary flow passages 48*h* out of the four passages 48*h*; and the four third auxiliary flow passages 48*h* and the one fourth auxiliary flow passage 48*i* are distant by 22.5 degrees from the four first auxiliary flow passages 48*f* and the one second auxiliary flow passage 48*g*, respectively. The second main flow passage 48*j* communicates, at one of opposite ends thereof, with the four third auxiliary flow passages 48*h* and the one fourth auxiliary flow passage 48*i*, and communicates, at the other end thereof, with the atmosphere via an opening formed in a lower surface of the flow-passage member 48*b*.

Figure 10B:
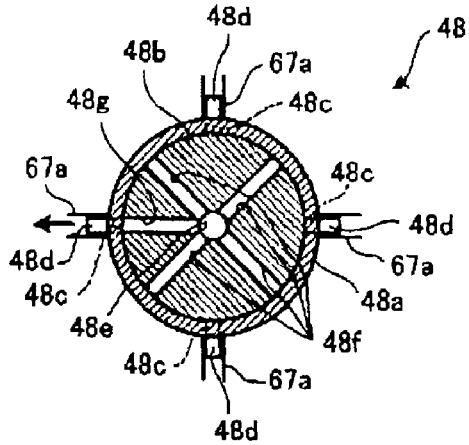
Figure 10C:
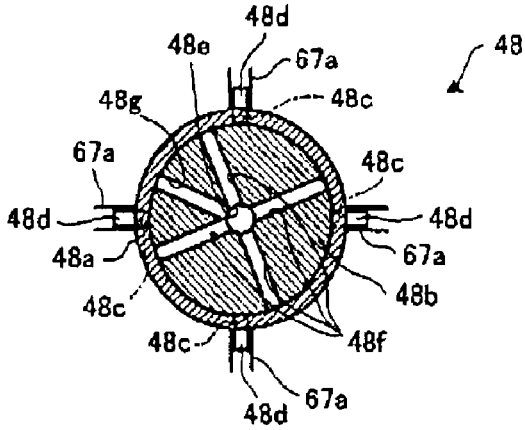
Figure 10D:
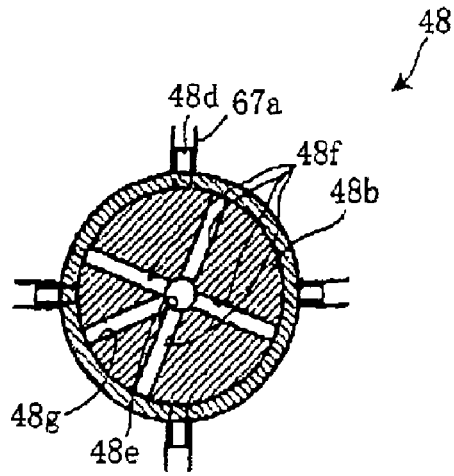
Figure 10E:
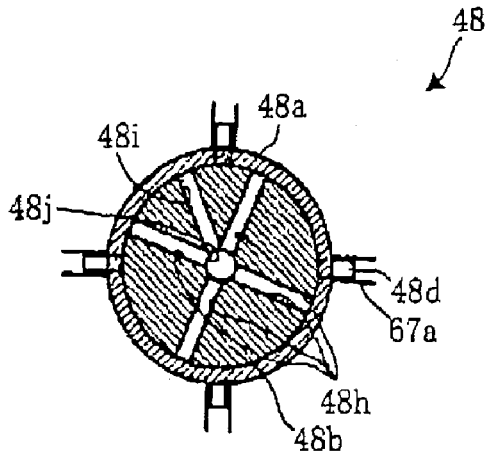
FIGS. 10E, 10F, 10G, and 10H are cross-sectional views showing different operating states of a lower portion of the switching unit that correspond to the different operating states of the upper portion of the switching unit shown in FIGS. 10A, 10B, 10C, and 10C, respectively.
Figure 10F:
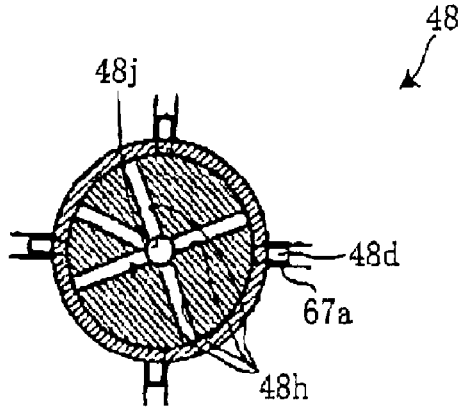
Figure 10G:
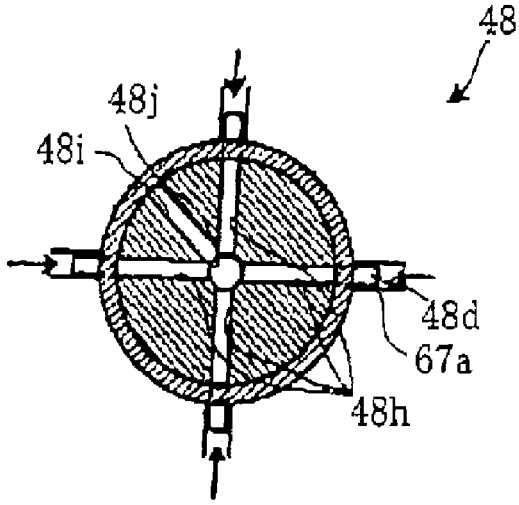
Figure 10H:
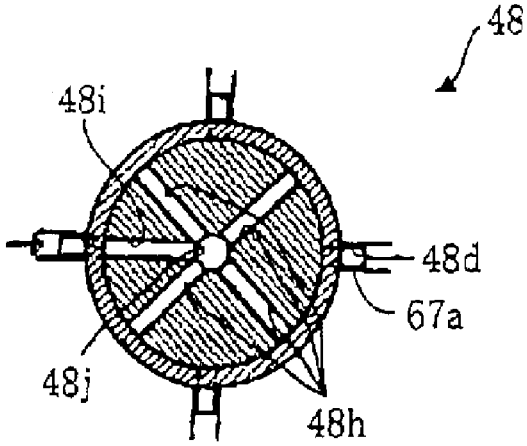

FIG. 10A shows a fully open state of the switching unit 48 in which the upper portion of the flow-passage member 48*b* takes a rotation position where the four first auxiliary flow passages 48*f* communicate with the four upper through holes 48*c*, respectively, so as to allow each of the four ink tanks 45 to communicate with the air tank 46. The fully open state of the switching unit 48 corresponds to a first fully non-communication state thereof shown in FIG. 10E, in which the lower portion of the flow-passage member 48*b* takes a rotation position where the four third auxiliary flow passages 48*h* do not communicate with the four lower through holes 48*c*, respectively, so as not to allow each of the four ink tanks 45 to communicate with the atmosphere. FIG. 10B shows a selectively open state of the switching unit 48 in which the upper portion of the flow-passage member 48*b* takes a rotation position where the second auxiliary flow passage 48*g* communicates with an arbitrary one of the four upper through holes 48*c*, so as to allow a corresponding one of the four ink tanks 45 to communicate with the air tank 46. The switching unit 48 can take an arbitrary one of four selectively open states corresponding to the four ink tanks 45. The selectively open state of the switching unit 48 corresponds to a second fully non-communication state thereof, shown in FIG. 10F, in which the lower portion of the flow-passage member 48*b* takes a rotation position where the four third auxiliary flow passages 48*h* do not communicate with the four lower through holes 48*c*, respectively, so as not to allow each of the four ink tanks 45 to communicate with the atmosphere. FIG. 10C shows a first closed state of the switching unit 48 in which the upper portion of the flow-passage member 48*b* takes a rotation position where the first and second auxiliary flow passages 48*f*, 49*g* do not communicate with any of the four upper through holes 48*c* so as to inhibit the communication between each of the four ink tanks 45 and the air tank 46. The first closed state of the switching unit 48 corresponds to a full atmosphere-communication state thereof, shown in FIG. 10G, in which the lower portion of the flow-passage member 48*b* takes a rotation position where the four third auxiliary flow passages 48*h* communicate with the four lower through holes 48*c*, respectively, so as to allow each of the four ink tanks 45 to communicate with the atmosphere. FIG. 10D shows a second closed state of the switching unit 48 in which the upper portion of the flow-passage member 48*b* takes a rotation position where the first and second auxiliary flow passages 48*f*, 49*g* do not communicate with any of the four upper through holes 48*c* so as to inhibit the communication between each of the four ink tanks 45 and the air tank 46. The second closed state of the switching unit 48 corresponds to a selective atmosphere-communication state thereof shown in FIG. 10H, in which the lower portion of the flow-passage member 48*b* takes a rotation position where the fourth auxiliary flow passages 48*i* communicates with an arbitrary one of the four lower through holes 48*c*, so as to allow a corresponding one of the four ink tanks 45 to communicate with the atmosphere. The switching unit 48 can take an arbitrary one of four selective atmosphere-communication states corresponding to the four ink tanks 45. The first and second closed states of the switching unit 48 can be considered as a single closed state of the switching unit 48; and each of the full atmosphere-communication state and the selective atmosphere-communication state of the switching unit 48 can be considered as a sub-state of the single closed state of the switching unit 48.

Figure 11:
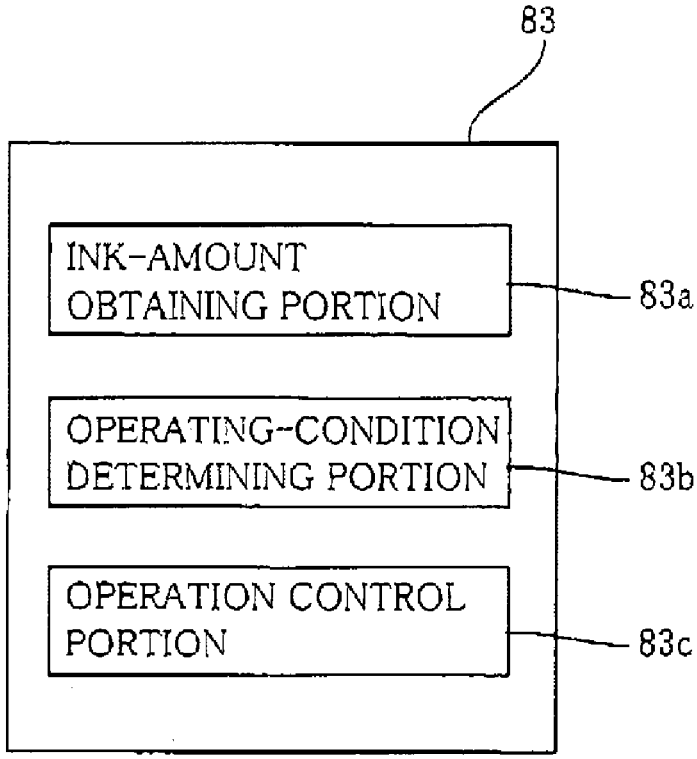
FIG. 11 is a diagrammatic view of a control device of the ink-jet printer.

Next, the control device 83 will be described by reference to FIG. 11. As described above, the control device 83 controls the ink-jet printer 101 as a whole, e.g., the ink-jet recording heads 1, the air pump 47, and the switching unit 48. The following description is focused on the function of the ink-jet printer 101 to carry out the purging operation in which air is supplied to the ink tank(s) 45 and the ink(s) is(are) forcedly discharged from the ink supply tube(s) 65 and the ink-jet head(s) 1. As shown in FIG. 11, the control device 83 includes an ink-amount obtaining portion 83*a*, an operating-condition determining portion 83*b*, and an operation control portion 83*c*.

The ink-amount obtaining portion 83*a* obtains an amount of the ink present in each of the ink tanks 45. More specifically described, the ink-amount obtaining portion 83*a* counts a total number of droplets of the ink ejected from the nozzles 8 of each ink-jet recording head 1 in all printing operations, and multiplies the counted number by an amount (or volume) of each ink droplet so as to obtain a consumed amount of the ink, and adds, to the thus obtained consumed amount of the ink, amounts of the ink that are outputted from the each ink-jet head 1 when the purging operations are carried out periodically or regularly, and irregularly when a user intends to recover the each ink-jet head 1 from a failure thereof to eject the ink. The ink-amount obtaining portion 83*a* calculates an amount of the ink present in the each ink tank 45, by subtracting the thus summed consumed amount of the ink, from an initial amount of the ink stored by the same 45. However, in place of, or in addition to the ink-amount obtaining portion 83*a*, the control device 83 may employ an air-amount obtaining portion that obtains an amount of air present in each of the ink tanks 45. In the latter case, the air-amount obtaining portion may obtain the amount (e.g., volume) of the air present in the each ink tank 45, by subtracting, from a volume of the each ink tank 45, the amount (e.g., volume) of the ink obtained by the ink-amount obtaining portion 83*a*.

The operation-condition determining portion 83*b* determines, based on the ink amount obtained by the ink-amount obtaining portion 83*a*, respective operating conditions of the air pump 47 and the switching unit 48, so that the air pressure(s) in the ink tank(s) 45 is(are) controlled to a predetermined value to carry out the purging operation. The operating conditions determined by the operating-condition determining portion 83*b* include timings when the switching unit 48 is operated; and at least one operation parameter of the air pump 47 with respect to an operation thereof during a time period from a time when the switching unit 48 takes its closed state to a time when the unit 48 takes the fully open state or an arbitrary one of the four selectively open states.

Whether the switching unit 48 takes the fully open state or an arbitrary one of the four selectively open states depends on the number of the ink-jet recording head(s) 1 for which the purging operation is to be carried out. More specifically described, in the case where the purging operation is carried out for an arbitrary one of the four ink-jet heads 1, the switching unit 48 is switched, at an appropriate timing, to a corresponding one of the four selectively open states; and in the case where the purging operation is carried out for all the four ink-jet heads 1, the switching unit 48 is switched, at an appropriate timing, to the fully open state.

Each purging operation includes discharging deteriorated ink through the nozzles 8, and discharging air bubbles produced in the main portion(s) 1*a* of the ink-jet recording head(s) 1, also through the nozzles 8. The purging operations include the periodic ones that are carried out periodically, and the user-intended ones that are carried out when the user intends to recover the ink-jet head(s) 1 from failure thereof to eject the ink(s).

The operation control portion 83*c* controls the air pump 47 and the switching unit 48, according to the operating conditions determined by the operating-condition determining portion 83*b*.

Figure 12:
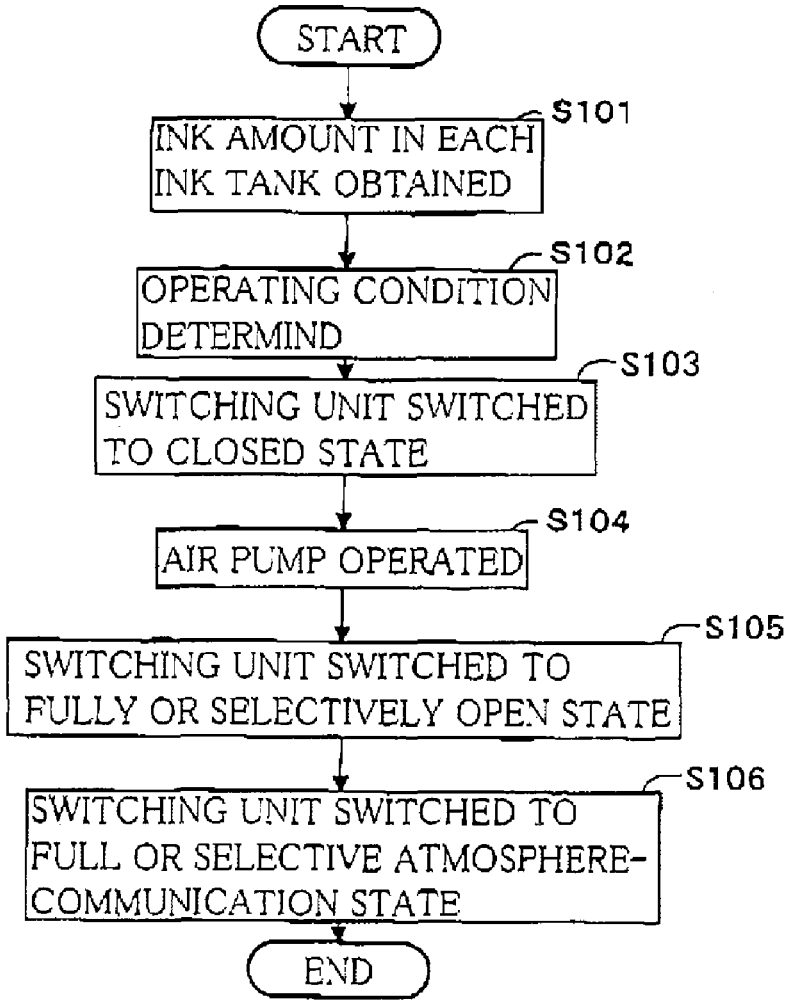
FIG. 12 is a flow chart representing a control program according to which the control device controls the ink-jet printer to carry out a purging operation.

Next, an operation of the control device 83 to carry out the purging operation will be described by reference to a flow chart shown in FIG. 12. First, at Step S101, the ink-amount obtaining portion 83*a* obtains the respective amounts of the inks present in the four ink tanks 45. Subsequently, at Step S102, the operating-condition determining portion 83*b* determines, based on the ink amounts obtained by the ink-amount obtaining portion 83*a*, operation timings of the switching unit 48 and an operation parameter of the air pump 47.

More specifically described, providing that a volume of the air pump 47 is expressed as $V_{47}$ (ml, milliliter); a volume of the air-pump communication tube 47*a* is expressed as $V_{47a}$ (ml); a volume of the air tank 46 is expressed as $V_{46}$ (ml); a volume of each individual air-supply tube 67*a* is expressed as $V_{67a}$ (ml); a volume of the common air-supply tube 67*b* is expressed as $V_{67b}$ (ml); a volume of the switching unit 48 is expressed as $V_{48}$ (ml); an air pressure in the air tank 46 is expressed as C (kPa); a volume of an air present in each ink tank 45 that is obtained by subtracting the obtained ink amount from a volume of the each ink tank 45 is expressed as D (ml); and a purging pressure is expressed as E (kPa), the following equation is met according to Boyle's law:

$$B\cdot C=(B+V_{67a}+D)\cdot E \text{ where } B=V_{47}+V_{47a}+V_{46}+V_{67b}+V_{48}$$

That is, providing that an initial air pressure in each ink tank 45 is zero, a product, (air pressure, C)×(volume, B), corresponding to a state before opening of the switching unit 48 is equal to a product, (purging pressure, E)×(volume, $B+V_{67a}+D$), corresponding to a state after the opening of the unit 48. Therefore, a desired value of the pressure C is so determined as to obtain desired value of the purging pressure E. In addition, a desired rotation amount, A, of the air pump 47 is so determined as to obtain the determined value of the pressure C; and a desired operation time, T, of the air pump 47 is determined based on the desired rotation amount A and a rotation speed, A', (rpm) of the air pump 47. Operation timings of the switching unit 48 are determined based on the desired operation time T of the air pump 47. Step S101 corresponds to the amount obtaining portion that obtains at least one of (a) the amount of the ink present in each ink tank 45 and (b) the amount of the air present in each ink tank 45.

Then, at Step S103, the switching unit 48 is switched to the closed state, so that the air tank 46 is air-tightly closed. Subsequently, at Step S104, the air pump 47 is operated for the operation time T determined at Step S102, i.e., till the rotation amount of the air pump 47 reaches the desired rotation amount A determined at Step S102. Thus, the air pressure in the air tank 46 is increased up to the determined value of the pressure C. Next, at Step S105, the switching unit 48 is switched to the fully open state or the selectively open state, so that the air tank 46 communicates with one or more ink tanks 45 corresponding to one or more ink-jet recording heads 1 for which the purging operation is to be carried out. Since the air pressure in the air tank 46 is equal to the determined value of the pressure C, the pressurized air stored in the air tank 46 instantaneously flows into the ink tank(s) 45 via the common air-supply tube 67*b* and the individual air-supply tube(s) 67*a*. Thus, the air pressure(s) in the ink tank(s) 45 is(are) increased up to the desired value of the purging pressure E, so that appropriate amount(s) of ink(s) flows or flow from the ink outlet(s) 45*d* of the ink tank(s) 45. The ink(s) flowing from the ink outlet(s) 45*d* of the ink tank(s) 45 flows or flow into the ink inlet(s) 61*a* of the ink-jet head(s) 1 via the ink supply tube(s) 65. The ink(s) flowing into the ink inlet(s) 61*a* of the ink-jet head(s) 1 flows or flow from the reservoir unit(s) 70 to the flow-channel unit(s) 4, and finally is(are) forcedly discharged from the nozzles 8. Thus, the air bubbles and/or deteriorated inks that remain in the main portion(s) 1*a* of the ink-jet head(s) 1 are discharged into an outside space, and thus the ink-ejecting performance(s) of the ink-jet head(s) 1 can be maintained.

At Step S106, after a predetermined time duration has elapsed, the switching unit 48 is switched to the full atmosphere-communication state or the selective atmosphere-communication state. Thus, the air pressure(s) in the ink tank(s) 45 is(are) instantaneously returned to the atmospheric pressure, so that the discharging of the ink(s) from the ink tank(s) 45 is instantaneously stopped. Thus, one purging operation is finished.

As is apparent from the foregoing description of the present ink-jet printer 101, the operating-condition determining portion 83*b* determines, based on the ink amount(s) obtained by the ink-amount obtaining portion 83*a*, the respective operating conditions of the air pump 47 and the switching unit 48, such that the air pressure(s) in the ink tank(s) 45 is(are) made equal to the purging pressure E. Therefore, irrespective of what amount(s) of the inks may be present in the ink tanks 45, the air pressures in the ink tanks 45 can be kept at the purging pressure E immediately after the switching unit 48 is switched to the fully open state or the selectively open state. Thus, the air bubbles and the deteriorated inks can be reliably removed from the ink-jet recording heads 1, while useless consumption of the inks is effectively prevented.

In addition, immediately after the switching unit 48 is switched to the fully open state or the selectively open state, the air pressure(s) in the ink tank(s) 45 is(are) made equal to the purging pressure E. Therefore, the inks can be efficiently expelled from the ink tanks 45, and accordingly the useless consumption of the inks is more effectively prevented.

In addition, when the switching unit 48 is switched to the full or selective atmosphere-communication state, the air pressure(s) in the ink tank(s) 45 is(are) immediately made equal to the atmospheric pressure, and the discharging of the ink(s) from the ink-jet recording heads 1 is immediately stopped. Therefore, the useless consumption of the inks is more effectively prevented.

In addition, since the switching unit 48 and the air supplying device (i.e., the air tank 46, the air pump 47, and the air-pump communication tube 47*a*) are commonly used with the plurality of ink-jet recording heads 1, the cost and size of the ink-jet printer 101 can be reduced.

Moreover, the ink-amount obtaining portion 83*a* counts the total number of droplets of ink ejected by the nozzles 8 of each ink-jet recording head 1 in all printing operations, and multiplies the counted number by the amount (or volume) of each ink droplet so as to obtain an ink consumption amount, and adds, to the thus obtained ink consumption amount, the total amount of ink that is discharged from the each ink-jet head 1 when the purging operations are carried out periodically or regularly, and irregularly when the user intends to recover the each ink-jet head 1 from its failure to eject ink. The ink-amount obtaining portion 83*a* calculates the amount of ink stored by the corresponding ink tank 45, by subtracting the thus calculated ink consumption amount from the initial amount of ink stored by the same 45. Therefore, the present ink-jet printer 101 need not employ any devices (e.g., sensors) for actually detecting the amounts of inks stored by the ink tanks 45.

Second Embodiment

Figure 13:
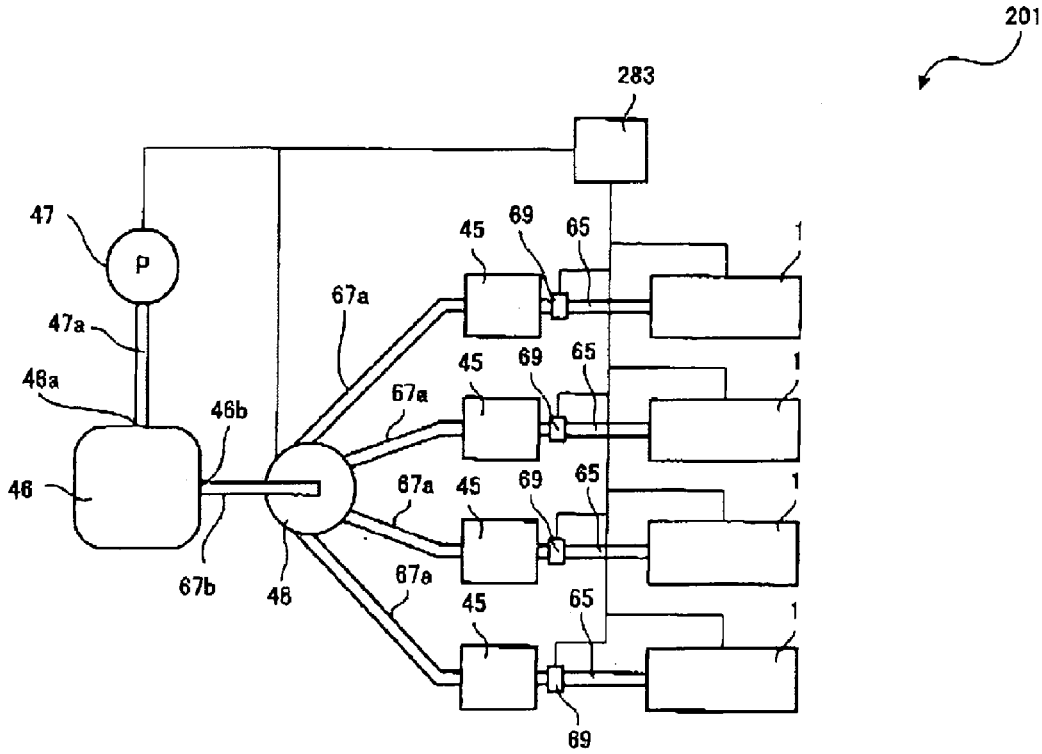
FIG. 13 is a schematic view corresponding to FIG. 1 and showing another ink-jet printer as a second embodiment of the present invention.
Figure 14:
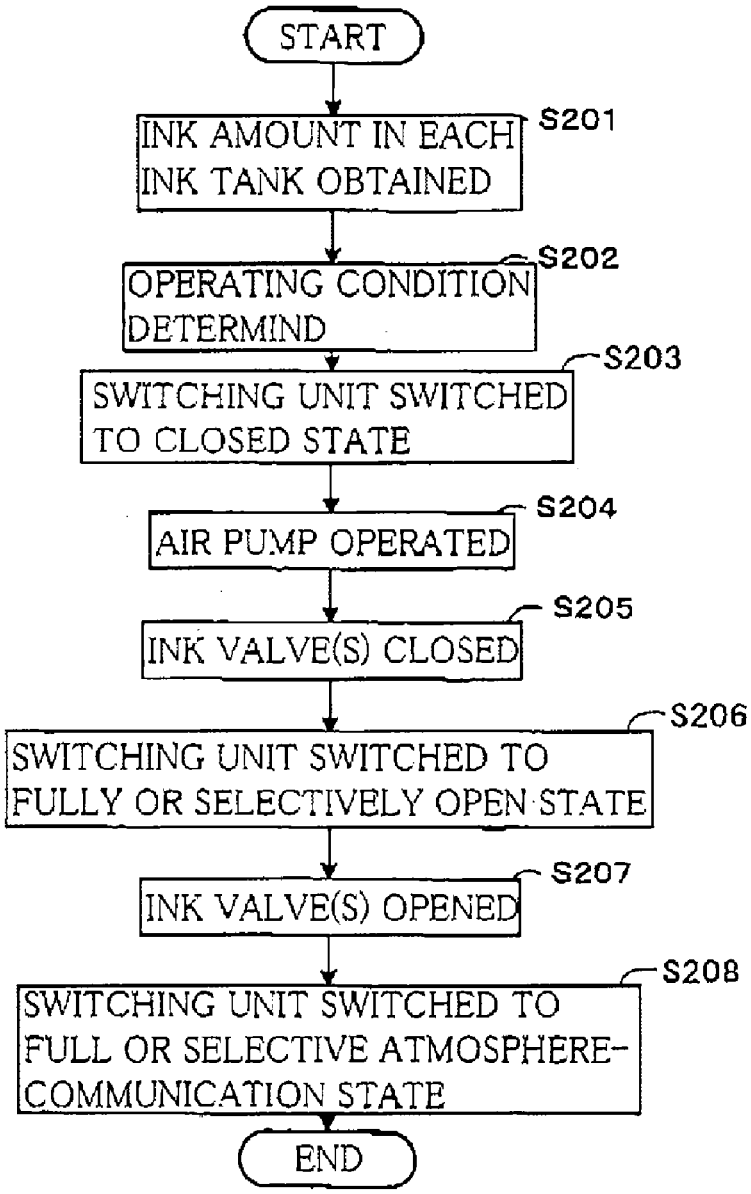
FIG. 14 is a flow chart corresponding to FIG. 12 and representing another control program according to which a control device of the ink-jet printer of FIG. 13 controls the ink-let printer to carry out a purging operation.

Next, a second embodiment of the present invention will be described by reference to FIGS. 13 and 14. The second embodiment relates to an ink-jet printer 201 as shown in FIG. 13. The same reference numerals as used in the first embodiment shown in FIGS. 1 through 9, 10A through 10H, and 11 are used to designate the corresponding elements or parts of the second embodiment, and the description thereof is omitted. As shown in FIG. 13, the ink-jet printer 201 includes the four ink-jet recording heads 1; the four ink tanks 45 corresponding to the four ink-jet recording heads 1; the air tank 46; the air pump 47; the switching unit 48; four ink valves 69; and a control device 283.

The four ink valves 69 are provided in the four ink supply tubes 65, respectively, and each of the ink valves 69 opens and closes, based on commands supplied from the control device 283, a corresponding one of the ink supply tubes 65.

The control device 283 controls the ink-jet printer 201 as a whole, e.g., the ink-jet recording heads 1, the air pump 47, the switching unit 48, and the ink valves 69. The control device 283 has a construction substantially identical with that of the control device 83 employed in the first embodiment. However, the operating-condition determining portion 83*b* additionally determines operation timings of each of the ink valves 69, and the operation control portion 83*c* additionally controls an operation of the each ink valve 69.

Next, an operation of the control device 283 to carry out a purging operation will be described by reference to a flow chart shown in FIG. 14. First, at Step S201, the ink-amount obtaining portion 83*a* obtains the respective amounts of the inks present in the four ink tanks 45. Subsequently, at Step S202, the operating-condition determining portion 83*b* determines, based on the ink amounts obtained by the ink-amount obtaining portion 83*a*, respective switching timings of the switching unit 48 and the ink valve(s) 69, and an operation time T of the air pump 47.

More specifically described, providing that a volume of the air pump 47 is expressed as $V_{47}$ (ml, milliliter); a volume of the air-pump communication tube 47*a* is expressed as $V_{47a}$ (ml); a volume of the air tank 46 is expressed as $V_{46}$ (ml); a volume of each individual air-supply tube 67*a* is expressed as $V_{67a}$ (ml); a volume of the common air-supply tube 67*b* is expressed as $V_{67b}$ (ml); a volume of the switching unit 48 is expressed as $V_{48}$ (ml); an air pressure in the air tank 46 is expressed as C (kPa); a volume of an air present in each ink tank 45 that is obtained by subtracting the obtained ink amount from a volume of the each ink tank 45 is expressed as D (ml); and a purging pressure is expressed as E (kPa), the following equation is met according to Boyle's law:

$$B\cdot C=(B+V_{67a}+D)\cdot E \text{ where } B=V_{47}+V_{47a}+V_{46}+V_{67b}+V_{48}$$

Therefore, a desired value of the pressure C is so determined as to obtain a desired value of the purging pressure E. In addition, a desired rotation amount A of the air pump 47 is so determined as to obtain the determined value of the pressure C; and a desired operation time T of the air pump 47 is determined based on the desired rotation amount A and a rotation speed A'(rpm) of the air pump 47. Switching timings of the switching unit 48 are determined based on the operation time T.

Then, at Step S203, the switching unit 48 is switched to the closed state, so that the air tank 46 is air-tightly closed. Subsequently, at Step S204, the air pump 47 is operated for the operation time T determined at Step S202, i.e., till the rotation amount of the air pump 47 reaches the desired rotation amount A determined at Step S202. Thus, the air pressure in the air tank 46 is increased up to the determined value of the pressure C. Next, at Step S205, all, or an arbitrary one, of the four ink valves 69 is closed. Subsequently, at Step S206, the switching unit 48 is switched to the fully open state or the selectively open state, so that the air tank 46 communicates with all, or an arbitrary one, of the four ink tanks 45 corresponding to all, or an arbitrary one, of the four ink-jet recording heads 1 for which the purging operation is to be carried out. Since the air pressure in the air tank 46 is made equal to the determined value of the pressure C, the air stored by the air tank 46 instantaneously flows into the ink tank(s) 45 via the common air-supply tube 67*b* and the individual air-supply tube(s) 67*a*. Thus, the air pressure(s) in the ink tank(s) 45 is(are) increased up to the desired value of the purging pressure E. Then, at Step S207, all, or the arbitrary one, of the four ink valves 69 is opened, so that appropriate amount(s) of ink(s) is(are) instantaneously expelled from the ink outlet(s) 45*d* of the ink tank(s) 45. The ink(s) flowing from the ink outlet(s) 45*d* of the ink tank(s) 45 flows or flow into the ink inlet(s) 61*a* of the ink-jet head(s) 1 via the ink supply tube(s) 65. The ink(s) flowing in the ink inlet(s) 61*a* of the ink-jet head(s) 1 flows or flow from the reservoir unit(s) 70 to the flow-channel unit(s) 4, and finally is(are) forcedly discharged from the nozzles 8. Thus, the air bubbles and/or the deteriorated inks that remain in the main portions 1*a* of the ink-jet heads 1 are discharged into an outside space, and the ink-ejecting performances of the ink-jet heads 1 can be maintained.

At Step S208, after a predetermined time duration has elapsed, the switching unit 48 is switched to the full or selective atmosphere-communication state. Thus, the air pressure(s) in the ink tank(s) 45 is(are) instantaneously returned to the atmospheric pressure, so that the discharging of the ink(s) from the ink tank(s) 45 is instantaneously stopped. Thus, one purging operation is finished.

As is apparent from the foregoing description of the present ink-jet printer 201, irrespective of what amount(s) of the ink(s) may be present in the ink tank(s) 45, the air pressure(s) in the ink tank(s) 45 can be kept at the purging pressure E immediately after the switching unit 48 is switched to the fully open state or the selectively open state. Thus, the air bubbles and the deteriorated inks can be removed from the ink-jet recording heads 1, while useless consumption of the inks is prevented.

In addition, after the air pressure(s) in the ink tank(s) 45 is(are) made equal to the purging pressure E, the ink valve(s) 69 is(are) opened to allow the ink(s) to flow from the ink tank(s) 45. Thus, the inks can be efficiently expelled from the ink tanks 45.

Third Embodiment

Figure 15:
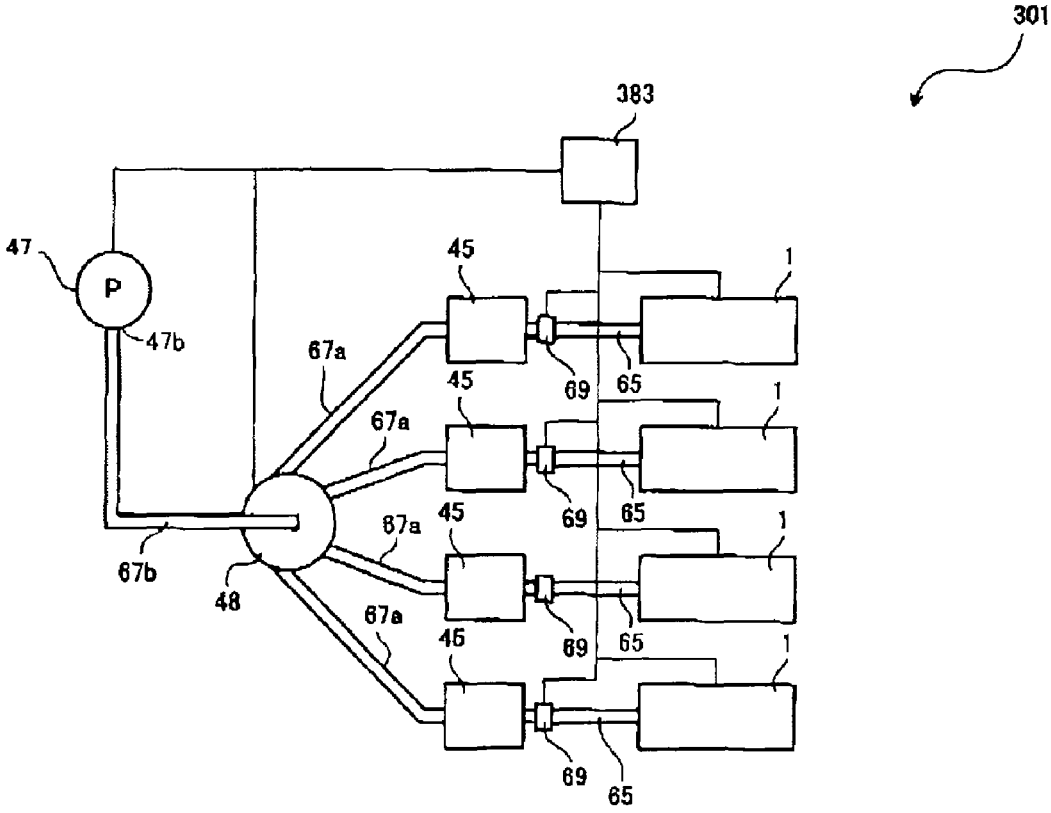
FIG. 15 is a schematic view corresponding to FIG. 1 and showing another ink-jet printer as a third embodiment of the present invention.
Figure 16:
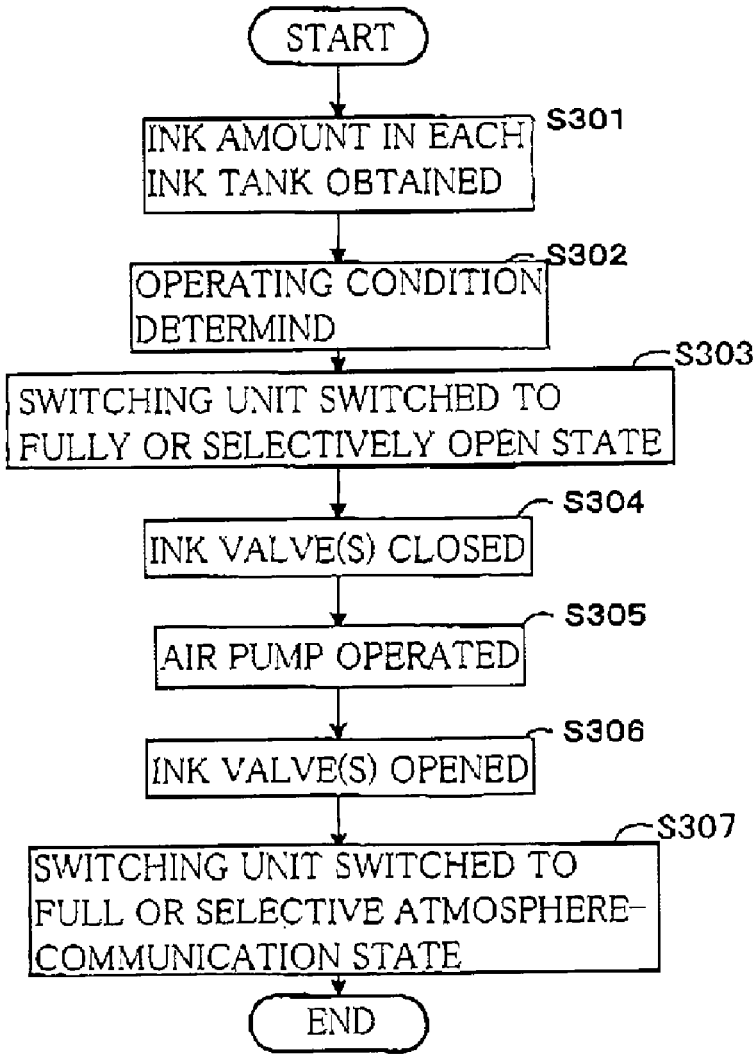
FIG. 16 is a flow chart corresponding to FIG. 12 and representing another control program according to which a control device of the ink-jet printer of FIG. 15 controls the ink-jet printer to carry out a purging operation.

Next, a third embodiment of the present invention will be described by reference to FIGS. 15 and 16. The third embodiment relates to an ink-jet printer 301 shown in FIG. 15. The same reference numerals as used in the first embodiment are used to designate the corresponding elements or parts of the third embodiment, and the description thereof is omitted. As shown in FIG. 15, the ink-jet printer 301 includes the four ink-jet recording heads 1; the four ink tanks 45 corresponding to the four ink-jet recording heads 1; the air pump 47; the switching unit 48; four ink valves 69; and a control device 383. The air pump 47 has an air outlet 47*b*.

The four ink valves 69 are provided in the four ink supply tubes 65, respectively, and each of the ink valves 69 opens and closes, based on commands supplied from the control device 383, a corresponding one of the ink supply tubes 65.

The control device 383 controls the ink-jet printer 301 as a whole, e.g., the ink-jet recording heads 1, the air pump 47, the switching unit 48, and the ink valves 69. The control device 383 has a construction substantially identical with that of the control device 83 employed in the first embodiment. However, the operating-condition determining portion 83*b* additionally determines operation timings of each of the ink valves 69, and the operation control portion 83*c* additionally controls an operation of the each ink valve 69.

Next, an operation of the control device 383 to carry out a purging operation will be described by reference to a flow chart shown in FIG. 16. First, at Step S301, the ink-amount obtaining portion 83*a* detects the amounts of the inks present in the four ink tanks 45. Subsequently, at Step S302, the operating-condition determining portion 83*b* determines, based on the ink amount(s) obtained by the ink-amount obtaining portion 83*a*, respective switching timings of the switching unit 48 and the ink valves 69, and an operation time of the air pump 47.

More specifically described, a desired rotation amount, a, of the air pump 47 is so determined that a pressure of an air (volume: D) present in each ink tank 45 that is obtained by subtracting the obtained ink amount from a volume of the each ink tank 45 is made equal to a desired value of the purging pressure E; and a desired operation time, T', of the air pump 47 is determined based on the desired rotation amount a and a rotation speed, a', (rpm) of the air pump 47. Switching timings of the switching unit 48 are determined based on the operation time T'.

Then, at Step S303, the switching unit 48 is switched to the fully open state or the selectively open state, so that the air pump 47 communicates with all, or the arbitrary one, of the four ink tanks 45 corresponding to all, or an arbitrary one, of the four ink-jet recording heads 1 for which the purging operation is to be carried out. Subsequently, at Step S304, all, or an arbitrary one, of the four ink valves 69 is closed. Then, at Step S305, the air pump 47 is operated for the operation time T' determined at Step S302, i.e., till the rotation amount of the air pump 47 reaches the rotation amount a determined at Step S302. Thus, the air pressure(s) in the ink tank(s) 45 is(are) increased up to the desired value of the purging pressure E. Next, at Step S306, all, or the arbitrary one, of the four ink valves 69 are(is) opened, so that appropriate amount(s) of ink(s) instantaneously is(are) expelled from the ink outlet(s) 45*d* of the ink tank(s) 45. The ink(s) flowing from the ink outlet(s) 45*d* of the ink tank(s) 45 flows or flow into the ink inlet(s) 61*a* of the ink-jet head(s) 1 via the ink supply tube(s) 65. The ink(s) flowing into the ink inlet(s) 61*a* of the ink-jet head(s) 1 flows or flow from the reservoir unit(s) 70 to the flow-channel unit(s) 4, and finally is(are) forcedly discharged from the nozzles 8. Thus, the air bubbles and/or the deteriorated inks that remain in the main portions 1*a* of the ink-jet heads 1 are discharged into an outside space, and the ink-ejecting performances of the ink-jet heads 1 can be maintained.

At Step S307, after a predetermined time duration has elapsed, the switching unit 48 is switched to the full or selective atmosphere-communication state. Thus, the air pressure(s) in the ink tank(s) 45 is(are) instantaneously returned to the atmospheric pressure, so that the discharging of the ink(s) from the ink tank(s) 45 is instantaneously stopped. Thus, one purging operation is finished.

As is apparent from the foregoing description of the present ink-jet printer 301, irrespective of what amount(s) of the ink(s) may be present in the ink tank(s) 45, the air pressure(s) in the ink tank(s) 45 can be kept at the purging pressure E when the purging operation is carried out. Thus, the air bubbles and the deteriorated inks can be reliably removed from the ink-jet recording heads 1, while useless consumption of the inks is prevented.

In addition, after the air pressure(s) in the ink tank(s) 45 is(are) made equal to the purging pressure E, the ink valve(s) 69 is(are) opened to allow the ink(s) to flow from the ink tank(s) 45. Thus, the inks can be efficiently expelled from the ink tanks 45.

Moreover, since each of the ink tanks 45 functions as an air tank in which air pressure is adjusted, the present ink-jet printer 301 need not employ any exclusive air tanks like the air tank 46 employed in the first or second embodiment.

While the present invention has been described in its preferred embodiments, it is to be understood that the present invention may otherwise be embodied.

For example, in each of the first to third embodiments, the switching unit 48 is switchable to the fall or selective atmosphere-communication state in which the ink tank(s) 45 is(are) communicated with the atmosphere so as to terminate forcibly the purging operation. However, the switching unit 48 may be one that is not switchable to the full or selective atmosphere-communication state. In this case, the ink tank(s) 45 cannot be communicated with the atmosphere, and the purging operation naturally terminates as the air pressure(s) in the ink tank(s) 45 gradually lowers or lower.

In addition, in the first or second embodiment, the ink-jet printer 101, 201 employs the air tank 46 and the switching unit 48. However, the ink-jet printer 101, 201 may be modified not to employ the air tank 46 or the switching unit 48. In this case, it is preferred that the air pump 47 be one that directly supplies a pressurized air having a predetermined pressure, to each of the ink tanks 45.

In each of the first and second embodiments, the air pressure in the air tank 46 is adjusted immediately before the purging operation is carried out. However, the ink-jet printer 101, 201 may be modified to adjust, beforehand, the air pressure in the air tank 46. In this case, the purging operation can be carried out quickly.

In each of the first and second embodiments, the air tank 46 and the air pump 47 cooperate with each other to provide the air supplying device. However, a different sort of air supplying device that can regulate the air pressure supplied to each of the ink tanks 45 may be employed.

In each of the first, second, and third embodiments, when the flow-passage member 48*b* is rotated in the switching unit 48, the unit 48 can be switched from the fully open state or the selectively open state to the first or second closed state corresponding to the full or selective atmosphere-communication state. However, the switching unit 48 may be modified such that the unit 48 is switchable from the fully open state or the selectively open state to the full or selective atmosphere-communication state that is independent of the first or second closed state, respectively.

In addition, in each of the first, second, and third embodiments, the ink-amount obtaining portion 83*a* calculates the total consumption amount of the ink ejected from each ink-jet recording head 1 in all printing operations, and the total consumption amount of the ink discharged from the each ink-jet head 1 when the purging operations are carried out periodically or regularly, and irregularly when the user intends to recover the ink-jet head 1 from its failure to eject the ink, and calculates the amount of the ink present in each ink tank 45, by subtracting the sum of the thus determined ink consumption amounts from the initial ink amount stored by the same 45. However, the ink-jet printer 101, 201, 301 may employ ink-amount sensors that actually or directly measure the respective amounts of the inks present in the ink tanks 45.

It is to be understood that the present invention may be embodied with other changes and improvements that may occur to a person skilled in the art, without departing from the spirit and scope of the invention defined in the claims.

What is claimed is:

1. An ink-jet printer, comprising:

an ink-jet recording head having an ink inlet into which an ink inflows;

an ink tank which has a known volume and stores the ink and which has an ink outlet from which the ink outflows and additionally has an air inlet into which an air inflows;

a first connector having an ink supply passage which communicates, at one end thereof, with the ink outlet of the ink tank and communicates, at an other end thereof, with the ink inlet of the ink-jet recording head, wherein the ink-jet recording head includes a plurality of nozzles each of which communicates with the ink tank via the ink supply passage and at least one of which ejects a droplet of the ink in a printing operation;

an air-pressure regulating device which has an air outlet from which the air outflows and additionally has a second connector having an air supply passage which communicates, at one end thereof, with the air outlet and communicates, at an other end thereof, with the air inlet of the ink tank;

a volume obtaining portion which obtains at least one of (a) a volume of the ink present in the ink tank and (b) a volume of the air present in the ink tank, wherein a sum of (a) the volume of the ink present in the ink tank and (b) the volume of the air present in the ink tank is equal to the known volume of the ink tank; and an operation control portion which controls, based on the volume obtained by the volume obtaining portion, an operation of the air-pressure regulating device to regulate a pressure of the air present in the ink tank, to a predetermined value so as to perform, in a state in which the ink jet recording head does not perform the printing operation, a purging operation in which the ink present in the nozzles of the ink-jet recording head is forcedly discharged into an outside space owing to the pressure of the air in the ink tank, regulated to the predetermined value.

2. The ink-jet printer according to claim 1, wherein the ink-jet recording head includes:

an ink inflow passage having the ink inlet;

a plurality of pressure chambers; and a plurality of individual ink flow passages each of which communicates, at one end thereof, with the ink inflow passage and communicates, at an other end thereof, with a corresponding one of the nozzles of the plurality of nozzles via a corresponding one of the pressure chambers.

3. The ink-jet printer according to claim 2, wherein the volume obtaining portion obtains the volume of the ink present in the ink tank, by summing respective volumes of the ink that are consumed at different times at each of which the ink is outputted from the nozzles of the ink-jet recording head, and subtracting the summed volumes of the ink, from an initial volume thereof.

4. The ink-jet printer according to claim 1, further comprising an operating-condition determining portion which determines, based on the volume obtained by the volume obtaining portion, an operating condition of the air-pressure regulating device such that when the operation control portion controls, according to the operating condition determined by the operating-condition determining portion, the operation of the air-pressure regulating device, the pressure of the air present in the ink tank is regulated to the predetermined value.

5. The ink-jet printer according to claim 4, wherein the air-pressure regulating device includes:

an air tank having the air outlet;

an air supplying device which supplies the air to the air tank; and at least one valve which is provided in the air supply passage communicating with the air outlet of the air tank, and which is selectively placed in an open state thereof in which said at least one valve opens the air supply passage, and a closed state thereof in which said at least one valve closes the air supply passage, wherein the operating-condition determining portion determines, as the operating condition of the air-pressure regulating device, an air charging condition needed to charge, in at least a portion of a time period when said at least one valve is in the closed state thereof, the air into the air tank, such that the air charging condition includes at least one operation parameter of the air supplying device with respect to an operation thereof to supply the air to the air tank before said at least one valve is switched from the closed state thereof to the open state thereof, and wherein when the obtained volume is (a) the volume of the ink present in the ink tank, the operation control portion controls, according to the determined air charging condition, the operation of the air supplying device such that as said obtained volume increases, a volume of the air supplied by the air supplying device to the air tank decreases and, when said at least one valve is switched from the closed state thereof to the open state thereof, the air is supplied from the air tank to the ink tank via the air supply passage so as to regulate the pressure of the air present in the ink tank to the predetermined value; and when the obtained volume is (b) the volume of the air present in the ink tank, the operation control portion controls, according to the determined air charging condition, the operation of the air supplying device such that as said obtained volume increases, a volume of the air supplied by the air supplying device to the air tank increases and, when said at least one valve is switched from the closed state thereof to the open state thereof, the air is supplied from the air tank to the ink tank via the air supply passage so as to regulate the pressure of the air present in the ink tank to the predetermined value.

6. The ink-jet printer according to claim 5, wherein the operating-condition determining portion additionally determines, as the air charging condition, each of a valve opening timing when said at least one valve is placed in the open state thereof and a valve closing timing when said at least one valve is placed in the closed state thereof.

7. The ink-jet printer according to claim 4, wherein the air-pressure regulating device includes:

an air supplying device which supplies the air to the ink tank via the air supply passage; and at least one valve which is provided in the ink supply passage communicating with the ink outlet of the ink tank, and which is selectively placed in an open state thereof in which said at least one valve opens the ink supply passage, and a closed state thereof in which said at least one valve closes the ink supply passage, wherein the operating-condition determining portion determines, as the operating condition of the air-pressure regulating device, an air charging condition needed to charge, in at least a portion of a time period when said at least one valve is in the closed state thereof, the air into the ink tank and thereby regulate the pressure of the air present in the ink tank to the predetermined value, such that the air charging condition includes at least one operation parameter of the air supplying device with respect to an operation thereof to supply the air to the ink tank before said at least one valve is switched from the closed state thereof to the open state thereof, and wherein when the obtained volume is (a) the volume of the ink present in the ink tank, the operation control portion controls, according to the determined air charging condition, the operation of the air supplying device such that as said obtained volume increases, a volume of the air supplied by the air supplying device to the ink tank decreases; and when the obtained volume is (b) the volume of the air present in the ink tank, the operation control portion controls, according to the determined air charging condition, the operation of the air supplying device such that as said obtained volume increases, a volume of the air supplied by the air supplying device to the ink tank increases.

8. The ink-jet printer according to claim 7, wherein the operating-condition determining portion additionally determines, as the air charging condition, each of a valve opening timing when said at least one valve is placed in the open state thereof and a valve closing timing when said at least one valve is placed in the closed state thereof.

9. The ink-jet printer according to claim 4, wherein the air-pressure regulating device includes:

an air tank including the air outlet and an air supply port into which the air inflows;

an air pump which supplies the air to the air supply port of the air tank; and an air valve which is provided in the air supply passage communicating with the air outlet of the air tank, and which is selectively placed in an open state thereof in which the air valve allows the air tank and the ink tank to communicate with each other, and a closed state thereof in which the air valve does not allow the air tank and the ink tank to communicate with each other, wherein the operating-condition determining portion determines, as the operating condition of the air-pressure regulating device, an air-valve opening timing when the air valve is placed in the open state thereof, an air-valve closing timing when the air valve is placed in the closed state thereof, and at least one operation parameter of the air pump with respect to an operation thereof in at least a portion of a time period between the air-valve closing timing and the air-valve opening timing, and wherein the operation control portion controls the air valve to be placed in the closed state thereof at the determined air-valve closing timing, and subsequently placed in the open state thereof at the determined air-valve opening timing, and controls, according to the determined at least one operation parameter of the air pump, the operation thereof in at least said portion of the time period between the determined air-valve closing timing and the determined air-valve opening timing.

10. The ink-jet printer according to claim 9, wherein said at least one operation parameter of the air pump comprises at least one of an operation speed and an operation time of the air pump.

11. The ink-jet printer according to claim 9, wherein in the closed state of the air valve, the air valve is selectively placed in an atmosphere-communication state thereof in which the air valve allows the ink tank to communicate with an atmosphere, and a non-communication state thereof in which the air valve does not allow the ink tank to communicate with the atmosphere, and wherein the operating-condition determining portion additionally determines, as the operating condition of the air-pressure regulating device, a timing when the air valve is placed in the atmosphere-communication state thereof.

12. The ink-jet printer according to claim 9, comprising a plurality of said ink-jet recording heads, a plurality of said ink tanks having the respective air inlets, and a plurality of said first connectors having the respective ink supply passages, wherein at least one said second connector has at least one said air supply passage which communicates, at at least one said one end thereof, with at least one said air outlet of the air tank and communicates, at a plurality of said other ends thereof, to the respective air inlets of the ink tanks, and wherein at least one said air valve is selectively placed in the open state thereof in which at least one said air valve allows the air tank and at least one of the ink tanks to communicate with each other, and the closed state thereof in which at least one said air valve does not allow the air tank and any of the ink tanks to communicate with each other.

13. The ink-jet printer according to claim 4, wherein the air-pressure regulating device includes:

an air tank including the air outlet and an air supply port into which the air inflows;

an air pump which supplies the air to the air supply port of the air tank;

an air valve which is provided in the air supply passage communicating with the air outlet of the air tank and which is selectively placed in an open state thereof in which the air valve allows the air tank and the ink tank to communicate with each other, and a closed state thereof in which the air valve does not allow the air tank and the ink tank to communicate with each other; and an ink valve which is provided in the ink supply passage communicating with the ink outlet of the ink tank and which is selectively placed in an open state thereof in which the ink valve allows the ink tank and the ink-jet recording head to communicate with each other, and a closed state thereof in which the ink valve does not allow the ink tank and the ink-jet recording head to communicate with each other, wherein the operating-condition determining portion determines, as the operating condition of the air-pressure regulating device, an air-valve opening timing when the air valve is placed in the open state thereof, an air-valve closing timing when the air valve is placed in the closed state thereof, an ink-valve closing timing when the ink valve is placed in the closed state thereof, such that the determined ink-valve closing timing is prior to the determined air-valve opening timing, an ink-valve opening timing when the ink valve is placed in the open state thereof, such that the determined ink-valve opening timing is subsequent to the determined air-valve opening timing, and at least one operation parameter of the air pump with respect to an operation thereof before the ink-valve opening timing, wherein the operation control portion controls the air valve to be placed in the closed state thereof at the determined air-valve closing timing, and subsequently placed in the open state thereof at the determined air-valve opening timing, and controls, according to the determined at least one operation parameter of the air pump, the operation thereof in at least said portion of the time period between the determined air-valve closing timing and the determined air-valve opening timing, and wherein the operation control portion controls the ink valve to be placed in the closed state thereof at the determined ink-valve closing timing, and subsequently placed in the open state thereof at the determined ink-valve opening timing.

14. The ink-jet printer according to claim 13, wherein in the closed state of the air valve, the air valve is selectively placed in an atmosphere-communication state thereof in which the air valve allows the ink tank to communicate with an atmosphere, and a non-communication state thereof in which the air valve does not allow the ink tank to communicate with the atmosphere, and wherein the operating-condition determining portion additionally determines, as the operating condition of the air-pressure regulating device, a timing when the air valve is placed in the atmosphere-communication state thereof.

15. The ink-jet printer according to claim 4, further comprising an ink valve which is provided in the ink supply passage communicating with the ink outlet of the ink tank, and which is selectively placed in an open state thereof in which the ink valve allows the ink tank and the ink-jet recording head to communicate with each other, and a closed state thereof in which the ink valve does not allow the ink tank and the ink-jet recording head to communicate with each other, wherein the air-pressure regulating device includes an air pump having the air outlet, and additionally includes the ink valve, wherein the operating-condition determining portion determines, as the operating condition of the air-pressure regulating device, an ink-valve closing timing when the ink valve is placed in the closed state thereof, an ink-valve opening timing when the ink valve is placed in the open state thereof and at least one operation parameter of the air pump with respect to an operation thereof in at least a portion of a time period between the ink-valve closing timing and the ink-valve opening timing, and wherein the operation control portion controls the ink valve to be placed in the closed state thereof at the determined ink-valve closing timing, and subsequently placed in the open state thereof at the determined ink-valve opening timing, and controls, according to the determined at least one operation parameter of the air pump, the operation thereof in at least said portion of the time period between the determined ink-valve closing timing and the determined ink-valve opening timing.

16. The ink-jet printer according to claim 15, wherein the air-pressure regulating device further includes an air valve which is provided in the air supply passage communicating with the air outlet of the air pump, and which is selectively placed in an open state thereof in which the air valve allows the air pump and the ink tank to communicate with each other, and a closed state thereof in which the air valve does not allow the air pump and the ink tank to communicate with each other, wherein in the closed state of the air valve, the air valve is selectively placed in an atmosphere-communication state thereof in which the air valve allows the ink tank to communicate with an atmosphere, and a non-communication state thereof in which the air valve does not allow the ink tank to communicate with the atmosphere, and wherein the operating-condition determining portion additionally determines, as the operating condition of the air-pressure regulating device, an air-valve closing timing when the air valve is placed in the closed state thereof, an air-valve opening timing when the air valve is placed in the open state thereof, and a timing when the air valve is placed in the atmosphere-communication state thereof.

17. The ink-jet printer according to claim 16, comprising a plurality of said ink-jet recording heads, a plurality of said ink tanks having the respective air inlets, and a plurality of said first connectors having the respective ink supply passages, wherein at least one said second connector has at least one said air supply passage which communicates, at at least one said one end thereof, with at least one said air outlet of the air pump and communicates, at a plurality of said other ends thereof, with the respective air inlets of the ink tanks, and wherein at least one said air valve is selectively placed in the open state thereof in which at least one said air valve allows the air pump and at least one of the ink tanks to communicate with each other, and the closed state thereof in which at least one said air valve does not allow the air pump and any of the ink tanks to communicate with each other.

18. The ink-jet printer according to claim 4, wherein the volume obtaining portion obtains the volume of the ink present in the ink tank, and obtains the volume of the air present in the ink tank by subtracting the obtained volume of the ink from the known volume of the ink tank, and the operating-condition determining portion determines, based on the obtained volume of the air, the operating condition of the air-pressure regulating device.

19. The ink-jet printer according to claim 1, wherein the air-pressure regulating device includes:

an air supplying device which supplies the air to the ink tank via the air supply passage; and at least one valve which is provided in at least one of the air supply passage and the ink supply passage, and which is selectively placed in an open state thereof in which said at least one valve opens said at least one of the air supply passage and the ink supply passage, and a closed state thereof in which said at least one valve closes said at least one of the air supply passage and the ink supply passage, and wherein, based on the volume obtained by the volume obtaining portion, the operation control portion controls said at least one valve to be placed in the closed state thereof and be subsequently switched from the closed state thereof to the open state thereof, and additionally controls, in at least a portion of a time period when said at least one valve is in the closed state thereof, the air supplying device to supply the air to the air supply passage.

20. The ink-jet printer according to claim 19, wherein the operation control portion controls, after said at least one valve has been switched from the closed state thereof to the open state thereof, the air supplying device not to supply the air to the air supply passage.

21. The ink-jet printer according to claim 1, wherein the volume obtaining portion obtains the volume of the air present in the ink tank, and the operation control portion controls, based on the obtained volume of the air in the ink tank, the operation of the air-pressure regulating device to regulate the pressure of the air in the ink tank, to the predetermined value.

22. The ink-jet printer according to claim 1, wherein the air-pressure regulating device includes an air supplying device which supplies the air to the ink tank via the air supply passage, and wherein the ink-jet printer further comprises an operating-condition determining portion which determines, based on the volume obtained by the volume obtaining portion, an operating condition of the air supplying device, such that when the obtained volume is (a) the volume of the ink present in the ink tank, the operation control portion controls, according to the determined operating condition, the operation of the air supplying device such that as said obtained volume increases, a volume of the air supplied by the air supplying device to the ink tank decreases; and when the obtained volume is (b) the volume of the air present in the ink tank, the operation control portion controls, according to the determined operating condition, the operation of the air supplying device such that as said obtained volume increases, a volume of the air supplied by the air supplying device to the ink tank increases.

23. A method of controlling an ink-jet printer including an ink-jet recording head having an ink inlet into which an ink inflows; an ink tank which has a known volume and stores the ink and which has an ink outlet from which the ink outflows and an air inlet into which an air inflows; a first connector having an ink supply passage which communicates, at one end thereof with the ink outlet of the ink tank and communicates, at an other end thereof, with the ink inlet of the ink-jet recording head, wherein the ink-jet recording head includes a plurality of nozzles each of which communicates with the ink tank via the ink supply passage and at least one of which ejects a droplet of the ink in a printing operation; and an air-pressure regulating device including an air outlet from which the air outflows, and a second connector having an air supply passage which communicates, at one end thereof, with the air outlet and communicates, at an other end thereof, with the air inlet of the ink tank, the method comprising:

obtaining at least one of (a) a volume of the ink present in the ink tank and (b) a volume of the air present in the ink tank, wherein a sum of the volume of the ink present in the ink tank and the volume of the air present in the ink tank is equal to the known volume of the ink tank, and controlling, based on the obtained volume, an operation of the air-pressure regulating device to regulate a pressure of the air present in the ink tank, to a predetermined value so as to perform, in a state in which the ink-jet recording head does not perform the printing operation, a purging operation in which the ink present in the nozzles of the ink-jet recording head is forcedly discharged into an outside space owing to the pressure of the air in the ink tank, regulated to the predetermined value.

24. The method according to claim 23, wherein the air-pressure regulating device includes:

an air supplying device which supplies the air to the ink tank via the air supply passage; and at least one valve is provided in at least one of the air supply passage and the ink supply passage, and which is selectively placed in an open state thereof in which said at least one valve opens said at least one of the air supply passage and the ink supply passage, and a closed state thereof in which said at least one valve closes said at least one of the air supply passage and the ink supply passage, wherein the controlling comprises controlling, based on the obtained volume, said at least one valve to be placed in the closed state thereof and be subsequently switched from the closed state thereof to the open state thereof, and additionally controlling, in at least a portion of a time period when said at least one valve is in the closed state thereof, the air supplying device to supply the air to the air supply passage, and wherein the controlling further comprises controlling, after said at least one valve has been switched from the closed state thereof to the open state thereof, the air supplying device not to supply the air to the air supply passage.

25. The method according to claim 23, wherein the obtaining comprises obtaining the volume of the air present in the ink tank, and wherein the controlling comprises controlling, based on the obtained volume of the air in the ink tank, the operation of the air-pressure regulating device to regulate the pressure of the air in the ink tank, to the predetermined value.

* * * * *